US006053300A

United States Patent [19]

Wood et al.

[11] Patent Number: 6,053,300

[45] Date of Patent: Apr. 25, 2000

[54] APPARATUS AND METHOD FOR DETERMINING THE VALIDITY OF A COIN

[75] Inventors: Dennis Wood, Oldham; Malcolm Reginald Hallas Bell, Leeds, both of United Kingdom

[73] Assignee: Coins Controls Ltd., Oldham, United Kingdom

[21] Appl. No.: 08/981,981

[22] PCT Filed: Apr. 2, 1996

[86] PCT No.: PCT/GB96/00804

§ 371 Date: Apr. 6, 1998

§ 102(e) Date: Apr. 6, 1998

[87] PCT Pub. No.: WO97/04424

PCT Pub. Date: Feb. 6, 1997

[30] Foreign Application Priority Data

Jul. 14, 1995 [GB] United Kingdom ..... 9514459
Nov. 2, 1995 [GB] United Kingdom ..... 9522455

[51] Int. Cl.[7] ..... G07D 5/08; G07D 5/02; G07F 1/04

[52] U.S. Cl. ..... 194/317; 194/335; 194/338; 194/344

[58] Field of Search ..... 194/334, 338, 194/317, 344, 335, 318

[56] References Cited

U.S. PATENT DOCUMENTS

| | | | |
|---|---|---|---|
| 3,559,790 | 2/1971 | Whitestone | 194/334 |
| 3,738,469 | 6/1973 | Prumm | 194/334 |
| 4,371,073 | 2/1983 | Dubey | 194/334 |
| 4,474,281 | 10/1984 | Roberts et al. | 194/334 |
| 4,538,719 | 9/1985 | Gray et al. | 194/100 |
| 4,542,817 | 9/1985 | Paulson | 194/335 |
| 4,601,380 | 7/1986 | Dean et al. | 194/318 |
| 4,646,904 | 3/1987 | Hoormann | 194/334 |
| 4,686,365 | 8/1987 | Meek et al. | 250/281 |
| 4,749,074 | 6/1988 | Ueui et al. | 194/317 |
| 4,754,862 | 7/1988 | Rawicz-Szczerbo et al. | 194/319 |
| 4,845,994 | 7/1989 | Quinlan, Jr. | 73/163 |
| 4,951,800 | 8/1990 | Yoshihara et al. | 194/317 |
| 4,995,497 | 2/1991 | Kai et al. | 194/318 |
| 5,007,520 | 4/1991 | Harris et al. | 194/317 |
| 5,033,603 | 7/1991 | Kai et al. | 194/334 |

(List continued on next page.)

FOREIGN PATENT DOCUMENTS

| | | |
|---|---|---|
| 0 155 126 A2 | 9/1985 | European Pat. Off. . |
| 0 164 110 A3 | 12/1985 | European Pat. Off. . |
| 0 384 375 B1 | 8/1990 | European Pat. Off. . |
| 0 404 432 A2 | 12/1990 | European Pat. Off. . |
| 2724868 | 12/1978 | Germany . |
| 1405936 | 8/1972 | United Kingdom . |
| 2 094 008 | 9/1982 | United Kingdom . |
| 2 169 429 | 7/1986 | United Kingdom . |
| 2 200 778 | 8/1988 | United Kingdom . |
| 2 238 152 | 5/1991 | United Kingdom . |
| WO 85 04037 | 9/1985 | WIPO . |

*Primary Examiner*—David A. Bucci
*Assistant Examiner*—Bryan Jaketic
*Attorney, Agent, or Firm*—Morgan & Finnegan, LLP

[57] ABSTRACT

A coin validator is provided with at least two reference positions (U, D) for determining a diameter related characteristic of a coin being validated. In order to reduce the running to the testing station, the timing of a trailing point of the coin passing a first reference position (U) is used to determine the diameter related characteristic. Embodiments using optical inductive and piezo-electric sensors associated with the reference positions are disclosed. An inductive sensor for a coin validator comprises an elongate coil, which, when in use, is arranged such that the magnetic field is substantially constant across the width of the passageway. The use of coils of this type have the advantage of wrap around coils but enable the coin passageway to be shallower and be opened. A coin validator is described wherein the backwall of a coin passageway is movable to and fro so that the depth of the coin passageway can be adjusted. In an embodiment, a cam bears against the backwall of the coin passageway to set the depth thereof.

100 Claims, 20 Drawing Sheets

U.S. PATENT DOCUMENTS

| | | | |
|---|---|---|---|
| 5,062,518 | 11/1991 | Chitty et al. | 194/317 |
| 5,085,309 | 2/1992 | Adamson et al. | 194/317 |
| 5,155,960 | 10/1992 | Shaanan | 52/884 |
| 5,158,166 | 10/1992 | Barson | 194/319 |
| 5,180,046 | 1/1993 | Hutton et al. | 194/319 |
| 5,226,520 | 7/1993 | Parker | 194/317 |
| 5,379,876 | 1/1995 | Hutton | 194/319 |
| 5,407,049 | 4/1995 | Jacobs | 194/317 |
| 5,460,256 | 10/1995 | Levasseur | 194/334 |
| 5,469,952 | 11/1995 | Kershaw et al. | 194/317 |
| 5,489,015 | 2/1996 | Wood | 194/318 |
| 5,515,960 | 5/1996 | Wood | 194/328 |
| 5,577,591 | 11/1996 | Abe | 194/343 |
| 5,657,847 | 8/1997 | Tod et al. | 194/207 |

$s_0$
25
U
$s_s$
D
(a)
(b)
$t_1$
(c)
$t_1$
(d)
$t_2$
$t_1$
$t_2$
$t_3$
(e)

APPARATUS AND METHOD FOR DETERMINING THE VALIDITY OF A COIN

FIELD OF THE INVENTION

The present invention relates to a coin validator.

BACKGROUND TO THE INVENTION

U.S. Pat. No. 4,474,281 discloses a coin validation apparatus wherein a pair of optical beams are directed across the coin path of a validator, substantially in the plane of a coin under test. The optical beams are spaced along the direction of travel of a coin in the coin path. The diameter of a coin is determined by timing the periods during which each of the optical beams is interrupted by passing coin, determining a value for the speed of the coin as it crosses the beams, deriving two diameter values from the timed periods and the speed values, and averaging the resultant values. The average produced is proportional to the diameter of the coin interrupting the beams.

If the apparatus of U.S. Pat. No. 4,474,281 is to function correctly, a coin to be tested must be in free fall before it encounters the first optical beam. A problem arises from this in that it is difficult to produce a compact validator with a sufficient run-in for a coin to be in free fall, before it interrupts the first optical beam. The problem is particularly acute in the case of validators for the large tokens used in some casinos.

DE-A-2 724 868 discloses an apparatus in which the diameter of a coin is checked on the basis of the time between the leading edge of the coin reaching a lower reference and the trailing edge of the coin leaving an upper reference position. However, this apparatus suffers from two disadvantages. Firstly, a counter is started when the coin reaches the upper reference position. Consequently, the upper reference position must be located at the diameter of the largest acceptable coin from the coin insertion slot. Secondly, the example, in which the diameter of a coin is checked on the basis of the time between the leading edge of the coin reaching a lower reference and the trailing edge of the coin leaving an upper reference position, cannot be used with coins whose diameters are not greater than the separation of the reference positions.

GB-A-1 405 936 discloses a coin validation apparatus comprising means defining first and second reference positions spaced along a coin path, sensor means for detecting a trading point on a coin passing the first reference position and a leading point on the coin reaching the second reference, and processing means for determining the velocity of a coin under test on the basis of the output of the sensor means. However, the diameter of the coin is checked using additional sensors.

In the following the term "coin" means coin, token and any similar objects representing value.

SUMMARY OF THE INVENTION

It is an aim of the present invention to overcome the afore-mentioned disadvantages of the prior art.

According to a first aspect of the present invention, there is provided a coin validation apparatus comprising means defining first and second reference positions spaced along a coin path, sensor means for detecting a trailing point on a coin passing the first reference position and a leading point on the coin reaching the second reference position, and processing means for checking the diameter of a coin under test on the basis of said trailing point passing the first reference position and said leading point reaching the second reference position, characterized in that the processing means checks the diameter of the coin under test without reference to said leading point reaching the first reference position. Preferably, the processing means checks the diameter of the coin under test on the basis of the time difference between said trailing point passing the first reference position and said leading point reaching the second reference position.

In some embodiments of the present invention, the diameter checked is the physical diameter of a coin under test. However, in other embodiments the diameter is checked on the basis of characterising signal representative of a property related to diameter but dependent also on additional factors such a the material from which a coin under test is made. The reference positions will, in practice, generally have a non-infinitesimal dimension in the direction of coin travel.

Thus, as the diameter-related characteristic determination is based on the time of a coin leaving the first reference position, there is no need for the run-in required by the prior art. Indeed, the first reference position can be located such that a coin extends across it even before a coin is full in the validator.

As a result of friction between a coin under test and the walls of the passageway and other factors, the speed of a coin passing through the optical beams is indeterminate and some correction for this is normally required. However, if the gap between the reference positions is the same as the diameter of a coin of interest, no correction is required. This is because, for a valid coin, the trailing point leaves the upstream reference position at the same time as the leading point enters the downstream reference position, regardless of the speed of the coin. Therefore, in one preferred embodiment, the reference positions are separated by the diameter of a coin type to be accepted by the validator. Additional reference positions could be added, each spaced from the first by the diameter of a coin type to be accepted. However, if more than a few denominations of coin are to be accepted, the complexity of this arrangement becomes undesirable.

In order to avoid this undesirable complexity, another preferred embodiment includes means to determine a velocity dependent value for a coin passing the reference positions, wherein the processing means is further responsive to the velocity dependent value for a coin under test to produce the characterising signal.

The means to determine a velocity dependent value may comprise means to determine the time elapsing between the trailing point passing the first reference position and the trailing point passing the second reference position.

However, the use of the first and second reference positions for velocity determination is not ideal if the coin accept gate is only a short distance below the second reference position. In such a case there may be insufficient time to process coin characterising signals before a decision must be made whether to open the accept gate. In order to overcome this situation, the means to determine a velocity dependent value may comprise a third reference position downstream of the first reference position and further sensor means for detecting said leading point reaching the third reference position, wherein the processing means is responsive to the sensor means to derive said velocity dependent value on the basis of the time difference between said leading point reaching the second reference position and said leading point reaching the third reference position. Thus, all the coin characterising data is obtained before the coin has passed fully through the last reference position.

Preferably, the processing means produces the characterising signal on the basis of the result of:

$$\frac{(t_1 - t_2)}{(t_3 - t_2)}$$

where:

$t_1$ is the time of trailing point passing the upper first reference position, and $t_2$ and $t_3$ are the times of the leading point reaching the second and third reference positions.

The trailing and leading points on a coin under test will be substantially on the circumference of the coin with some types of sensor. However, the operation of other sensors means the leading and trailing points will be located radially inward of the coins circumference with one on either side of a diameter of the coin, which runs perpendicular to the coin's direction of travel.

Preferably, the sensor means comprises a beam of optical radiation crossing the coin path and a detector therefor for each said reference position. More preferably, the coin path has a breadth to accommodate the thickness of a coin under test, a width to accommodate the coin's diameter, and a length along which coins under test can pass edgewise, wherein the sensor means includes emitter means on one side of the passageway for directing said beams of optical radiation across the width of the passageway and detectors opposite respective emitter means. If the beams are closely spaced, it is advantageous that adjacent beams shine in opposite directions across the coin passageway. This avoids one beam being detected by the photosensor of another beam.

However, other forms of sensor may be used. For instance, the sensor means may comprise inductive sensors. In a preferred embodiment using inductive sensors, the coin path has a breadth to accommodate the thickness of a coin under test, a width to accommodate the coin's diameter, and a length along which coins under test can pass edgewise, wherein the sensor means includes an elongate inductor arranged substantially parallel to the width direction of the path and having its winding axis substantially parallel to the direction of travel of coins along the path.

In a further embodiment, the sensor means comprises a piezo-electric element associated with each reference position, the piezo-electric elements being arranged to be stressed by the passage of a coin to produce electric signals. Preferably, at least one of the piezo electric elements comprises a flap, arranged to stress a piezo-electric film as a passing coin displaces it.

According to the first aspect of the present invention, there is further provided a method of validating a coin comprising the steps of:

(a) moving a coin edgewise past first and second reference positions, the reference positions being fixed relative to each other, and (b) determining the time difference between a trading point on the coin passing the first reference position and a leading point on the coin reaching the second reference; characterized by (c) checking the diameter of the coin on the basis of said time difference without reference to said leading point reaching the first reference position.

Preferably, a method according to the present invention includes the step of producing a coin velocity dependent value, wherein said velocity dependent value is used to derive the value characteristic of the coin. More preferably, such a method comprises the steps of:

(d) moving a coin edgewise past a third reference position;

(e) determining the time difference between said leading point reaching the second reference position and said leading point reaching the fourth reference;

(f) deriving a value representative of the coin's velocity on the basis of said time difference.

Preferably, optical sensing means are used to detect a trailing point on the coin's circumference passing the first reference position and a leading point on the coin's circumference reaching the second reference. However, inductive sensing means or piezo-electric sensing means could be used for determining said time difference or differences.

In many situations, merely measuring the diameter of a disc will not be sufficient to determine whether it is a valid member of a predetermined set of coin types. Typically, additional information will be derived using inductive sensors. In one type of inductive sensor, a cod is arranged beside the coin passageway, with its axis perpendicular to the plane of a coin travelling along the passageway. These inductive sensors are undesirable for compact coin validators if they are wound in the form of a circle or square because this increases the length required for the passageway. However, reducing the dimensions of the coil in the direction of travel of coins to be tested, produces an unacceptable degradation of performance.

A solution to this problem is the use of so called "wrap around" coils. Wrap around coils are arranged so that a coin to be tested passes along the axis of the coil. However, these coils cannot be opened for maintenance or rejection of jammed coins. This often necessitates a wider than desired gap through which coins under test pass, reducing sensitivity.

It is also an aim of the present invention to overcome the afore-mentioned disadvantages of prior art validator coil arrangements.

According to a second aspect of the present invention, there is provided a coin validation apparatus comprising means defining a passageway for coins under test, the passageway having a breadth to accommodate the thickness of a coin under test, a width to accommodate the coin's diameter, and a length along which coins under test can pass edgewise, and an inductive coin sensing station including a coil assembly beside the passageway and arranged to inductively couple with a major face of a coin therein, characterized in that the coil assembly is arranged such that the magnetic field produced thereby is substantially constant across the width of the passageway.

Preferably, the inductive coin sensing station comprises first and second coils opposite each other across the breadth of the passageway and having their axes substantially parallel to the direction of travel of a coin in the passageway past the sensing station. With such an arrangement, the coils can be switched between in-phase and anti-phase modes of operation. This cannot, of course, be achieved using a wraparound coil.

Preferably, the or each coil is wound in the form of an elongate oval or rectangle on a former of magnetic material which is, at least, substantially as long as the passageway is wide. Advantageously, the or each coil includes an elongate I-section former. However, an E- or C-section former may be used. If the former is E-sectioned, the coil may be wound around the top, bottom or middle arms. If the former is C-sectioned, the coil may be wound around any part.

Preferably, a validator includes shielding means to magnetically shield portions of the or each coil not immediately adjacent the passageway.

The slim shape of the coils employed in a validator according to this second aspect enables a more compact validator to be constructed. Alternatively, the space saved can be used for additional sensors of the same or different types. Since the windings of these coils include portions lying parallel to the coin passageway across its entire width, the magnetic field produced in the passageway is substantially constant across the width of the passageway. Consequently, the response to the passage of a coin, obtained from these coils, is independent of the position of a coin across the width of the passageway. This is particularly advantageous in the case of validators where coins are in free fall past the inductive sensor station because the path followed by a coin cannot be rigidly controlled Another advantage of the shape of these coils is that they are easier to screen than the coils used in prior art validators.

It has been found that coils of this type are more linear in their response to passing coins than prior art designs.

According to a third aspect of the present invention, there is provided a coin validating apparatus comprising a coin path having a breadth sufficient to accommodate the thickness of a coin under test, wherein a wall, defining in part said breadth, is repositionable to thereby vary said breadth. Preferably, a cam is ranged to act on said wall for repositioning thereof. More preferably, a sense coil is mounted to said wall for sensing a coin moving along the coin path.

Whilst the different aspects of the present invention provide significant advantages when applied individually, a compact validator, particularly suited to the validation of large "casino" tokens, can be constructed by applying both the first and second aspects. In such a validator, the inductive coin sensing station is preferably located between the upstream coin sensing station and the or a sequentially first downstream coin sensing station.

BRIEF DESCRIPTION OF THE DRAWINGS

Embodiments of the present invention will now be described, by way of example, with reference to the accompanying drawings, in which.

DETAILED DESCRIPTION OF EMBODIMENTS

Figure 1:
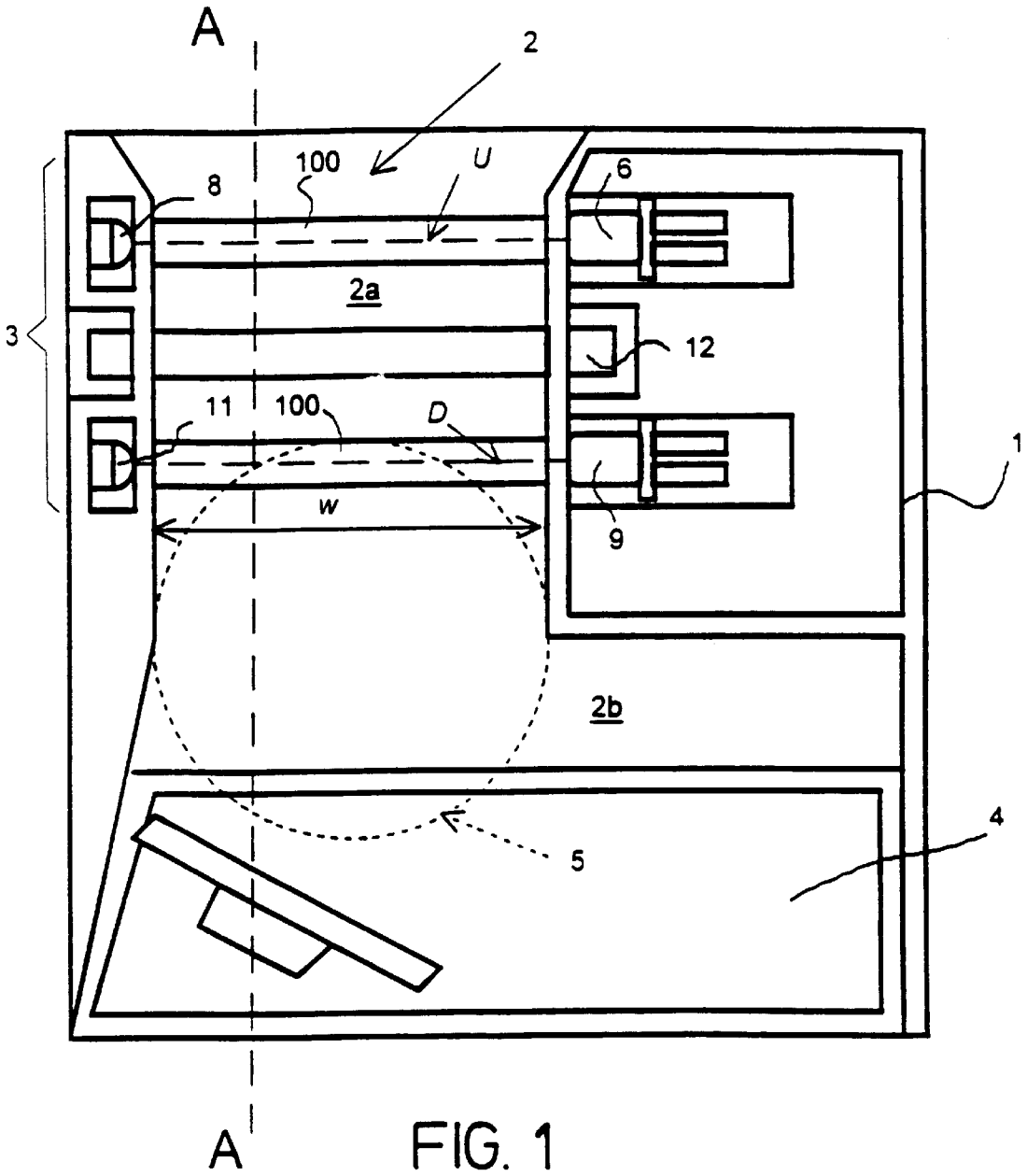
FIG. 1 shows a validator according to a first embodiment of the present invention with its front cover removed.
Figure 2:
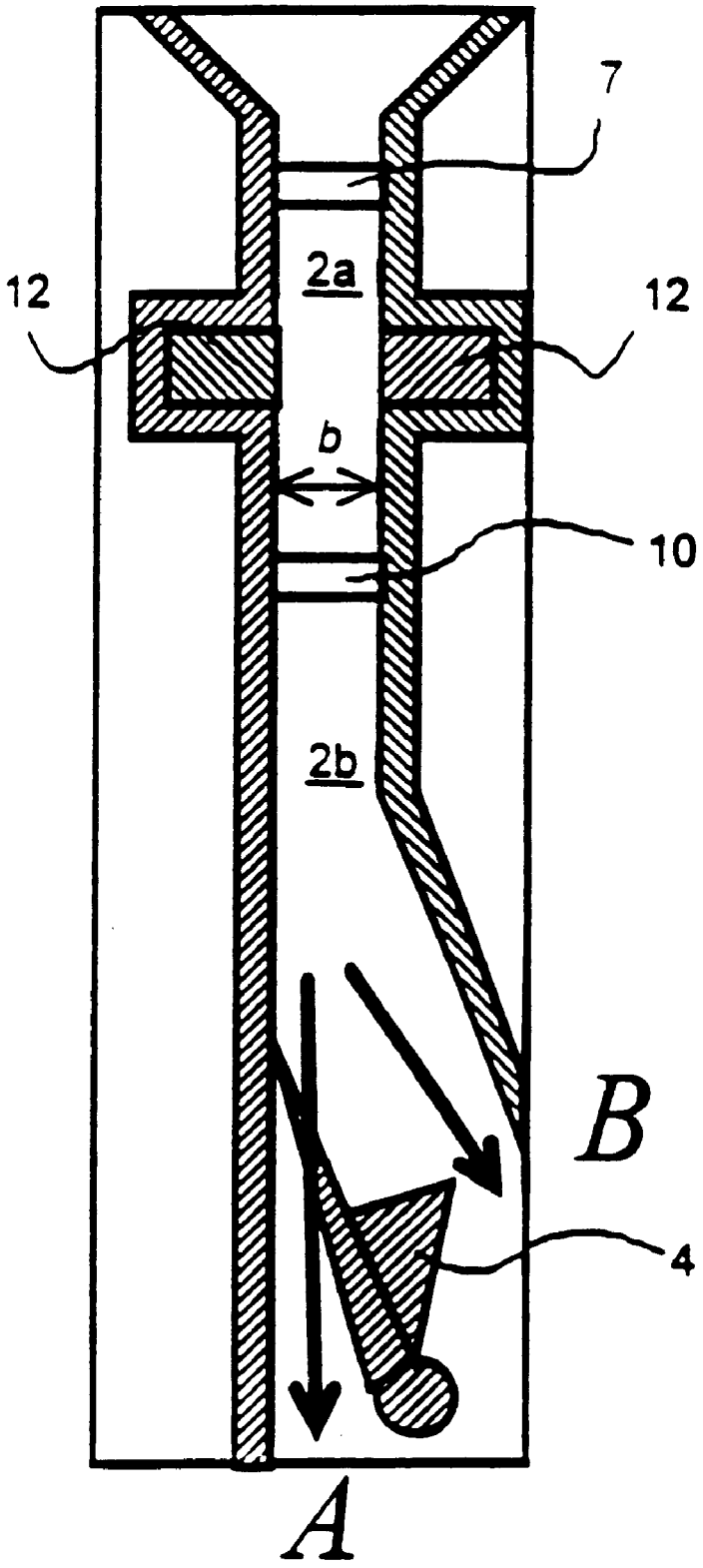
FIG. 2 is a sectional view along A—A of the validator of FIG. 1.

Referring to FIGS. 1 and 2, a coin validator body 1 defines a rectangular cross-section coin passageway 2. The passageway 2 comprises a straight, vertical upper portion , where various sensor stations 3 are located and a wider lower portion 2*b*. An accept gate 4 is arranged for diverting coins along either of two routes A, B. The accept gate 4 normally blocks route A but is opened if the signals from the sensor stations 3 indicate that a valid coin has been inserted into the validator. The upper portion 2*a* of the passageway 2 has a width w greater than the diameter of the largest coin 5 of interest and a depth b greater than the thickness of the thickest coin of interest. The entry to the upper portion 2*a* of the passageway is flared so as to simplify alignment of the validator with a coin insertion slot (not shown).

Considering the sensor stations 3 in more detail, an upstream optical sensor station comprises a lensed light emitting diode (LED) 6 mounted in the validator body 1, so as to shine a beam U of light across the width w of the passageway 2 through a slit 7 opening into the passageway 2. The slit 7 extends across the full depth b of the upper portion 2*a* of the passageway. A lensed photosensor 8 aligned to receive the beam from the LED 6 completes the upstream optical sensor station. A downstream optical sensor is similarly constructed from a lensed LED 9, a slit 10 and a lensed photosensor 11 to shine a beam D across the passageway 2, and is located a short distance below the upstream sensor. Two elongate sense coils 12 are located between the upstream and the downstream optical sensor stations. The sense coils 12 are press fitted longitudinally into respective slots extending transversely across the width w of the upper portion 2*a* of the passageway. The sense coils 12 will be described in more detail below.

Figure 3:
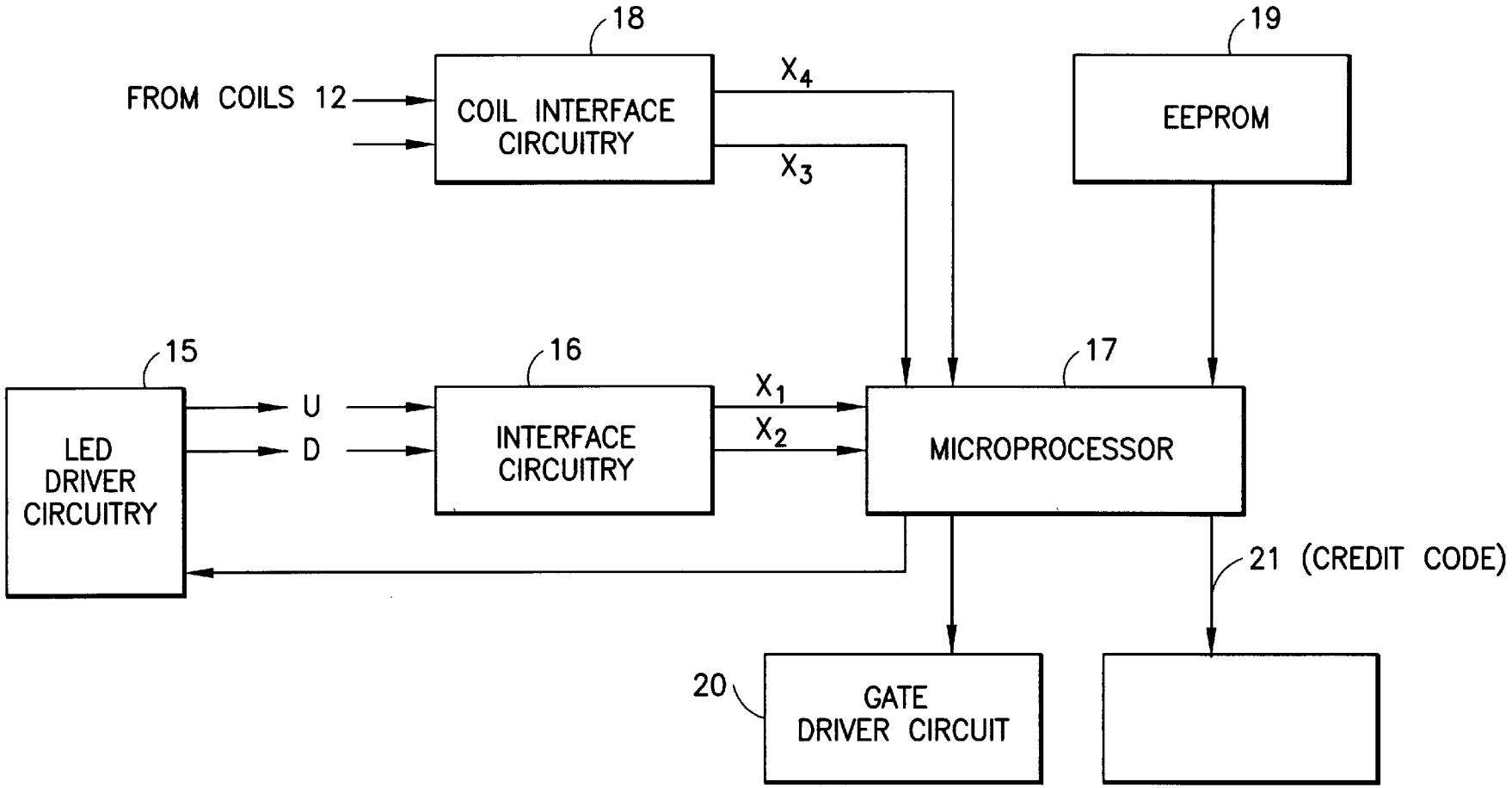
FIG. 3 is a block diagram of the electronic circuit of the validator of FIG. 1.
Figure 4:
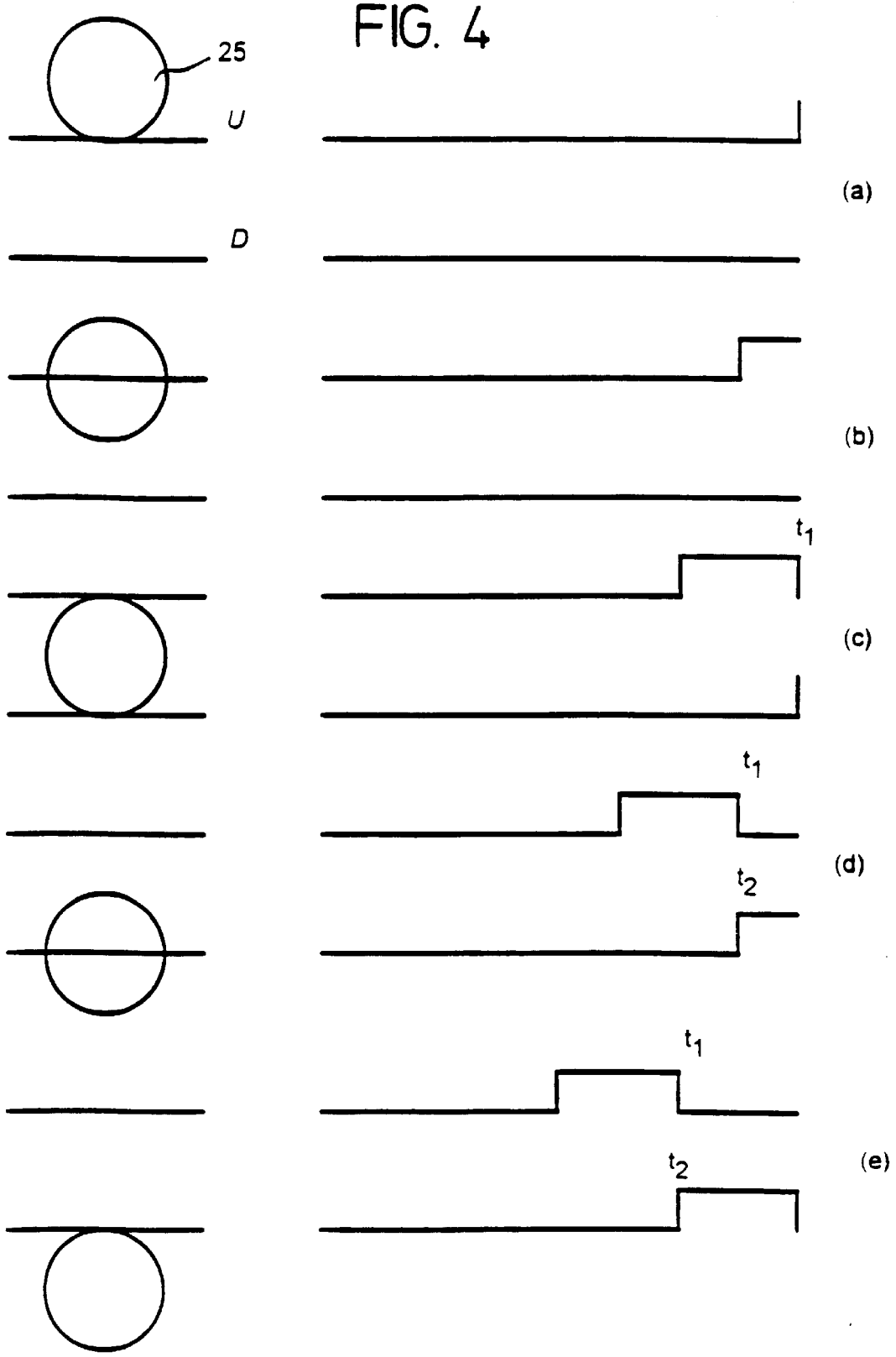
FIGS. 4*a* to 4*e* illustrate the passage of a coin past the optical sensor stations of the validator of FIG. 1 operating according to the first embodiment of the present invention with its front cover removed.

Referring to FIG. 3, the LEDs 6,9 are driven by LED driver circuitry 15 in order to produce the upstream and downstream beams U,D. The LEDs 6,9 typically produce optical radiation in the infra-red range although visible radiation can also be used. It will thus be appreciated that as used herein, the term optical radiation includes both visible and non-visible optical radiation.

The photosensors 8,11 are connected to interface circuitry 16 which produces digital signals $x_1$, $x_2$ in response to interruptions of the upstream and downstream beams U,D, as a coin falls along the passageway 2 past the sensor stations 3. The coin signals $x_1$, $x_2$ are fed to a microprocessor 17. As explained in our United Kingdom patent application no. 2 169 429, the inductive coupling between the coils 12 and a passing coin 5 gives rise to apparent impedance changes for the coil which are dependent on the type of coin under test. The apparent impedance changes are processed by coil interface circuitry 18 to provide a coin parameter signals $x_3$, $x_4$, which are a function of the apparent impedance changes.

The microprocessor 17 carries out a validation process on the basis of the signals $x_1$, $x_2$, $x_3$, $x_4$ under the control of a program, stored in an EEPROM 19.

If, as result of the validation processes performed by the microprocessor 17, the coin is determined to be a true coin, a signal is applied to a gate driver circuit 20 in order to operate the accept gate 4 (FIG. 1) so as to allow the coin to follow the accept path A. Also, the microprocessor 17 provides an output on line 21, comprising a credit code indicating the denomination of the coin.

The determination of the validity of coins on the basis of signals from sense coils is well known in the art and, accordingly, will not be described again here in detail.

The operation of the coin diameter determining function, according to a first embodiment, will now be described with reference to FIGS. 4*a* to 4*e*. In this embodiment, the upstream and downstream beams U,D are spaced by the diameter of the coin or token to be identified by the validator.

Referring to FIG. 4*a*, a coin 25, entering the passageway 2 (FIG. 1), first intercepts the upstream beam U. Unless the thickness of the coin corresponds to the depth b of the passageway 2, the beam U will not be fully blocked. However, there will be, in any event, a significant reduction in the light intensity detected by the photosensor 8 (FIG. 1). Therefore, the output of the photosensor 8 is compared with a reference to determine whether the received light intensity has reduce& indicating an incursion into the upstream beam U by a coin. If an incursion is detected, the state of signal $x_1$ changes. This change in state is not important for coin diameter determination but may conveniently be used as a wake up signal for the microprocessor 17 (FIG. 3).

Referring to FIG. 4*b*, as the coin 25 continues to fall down the passageway 2, it continues to block the upstream beam, at least partially, and the state of signal $x_1$ is maintained.

Referring to FIG. 4*c*, if the coin 25 is of the desired type, it intercepts the downstream beam D just as it is leaving the upstream beam U. This results in virtually simultaneous changes in the states of the signals $x_1$ and $x_2$. In other words, $t_1=t_2$. In practice, $t_1$ may not exactly equal $t_2$ due to component tolerances or environmental factors such as temperature. Thus, when the microprocessor 17 (FIG. 3) detects that either $x_1$ has returned to its original state or that $x_2$ has changed state to indicate the presence of a coin, it waits to see if the other signal makes the appropriate change of state within a predetermined window. If the other signal makes the appropriate change of state during the window, and inductive test data derived from the coils 12 (FIG. 1), is in agreement, the microprocessor 17 (FIG. 3) sends a signal to the gate drive circuit 20 (FIG. 3) to open the accept gate 4 (FIG. 1).

FIGS. 4*d* and 4*e* show the coin 25 leaving the sensor stations 4.

It will be appreciated that further downstream beams could be added, spaced from the upstream beam by the diameters of other coins or tokens, so that a plurality of types of coin or token could be identified.

A second embodiment of the present invention will now be described with reference to FIGS. 3, 5, 6*a* to 6*e* and 7*a* to 7*d*, wherein like parts have the same reference signs as in FIGS. 1 and 2.

Figure 5:
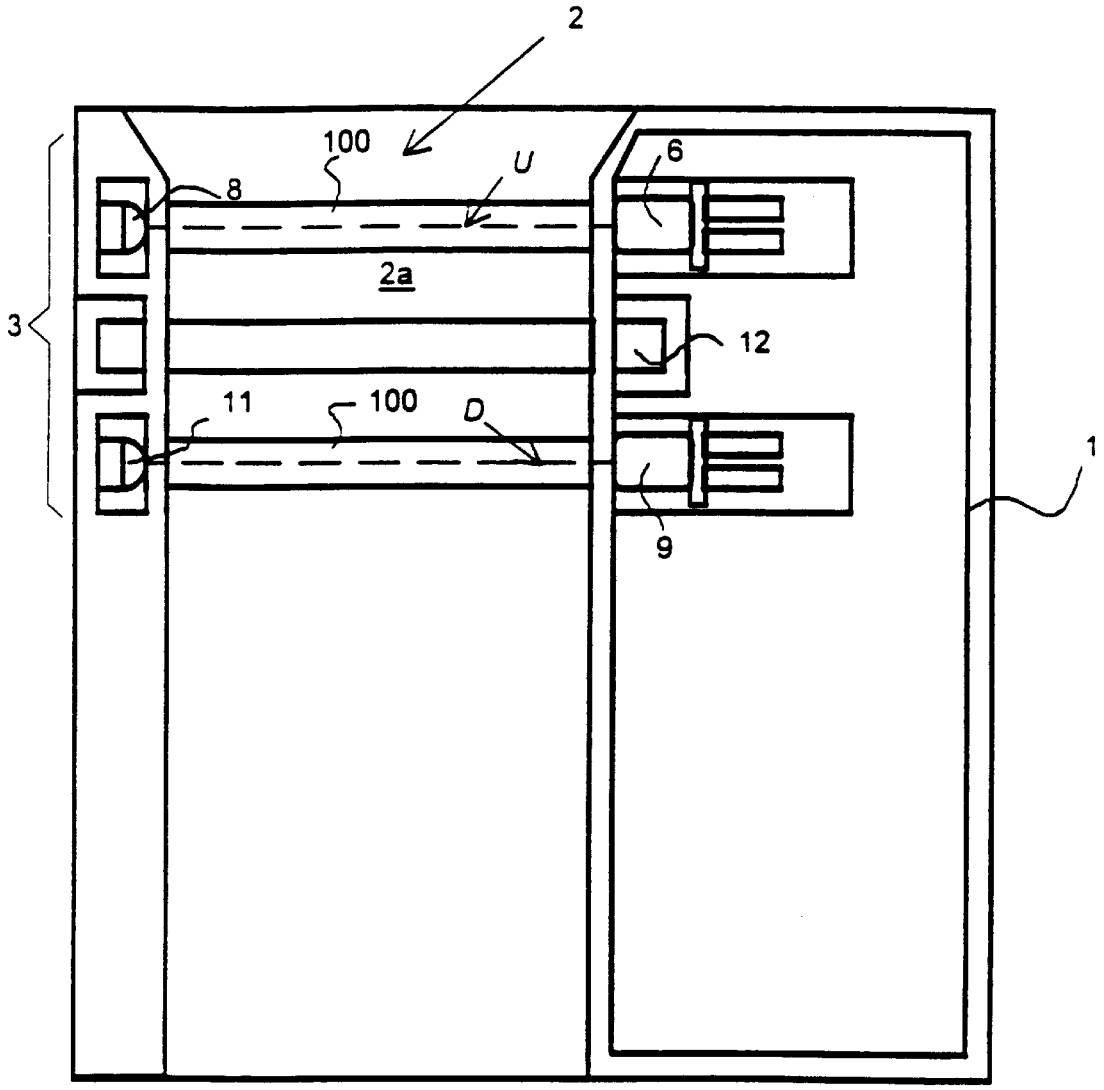
FIG. 5 is a validator according to a second embodiment of the present invention.
Figure 6:
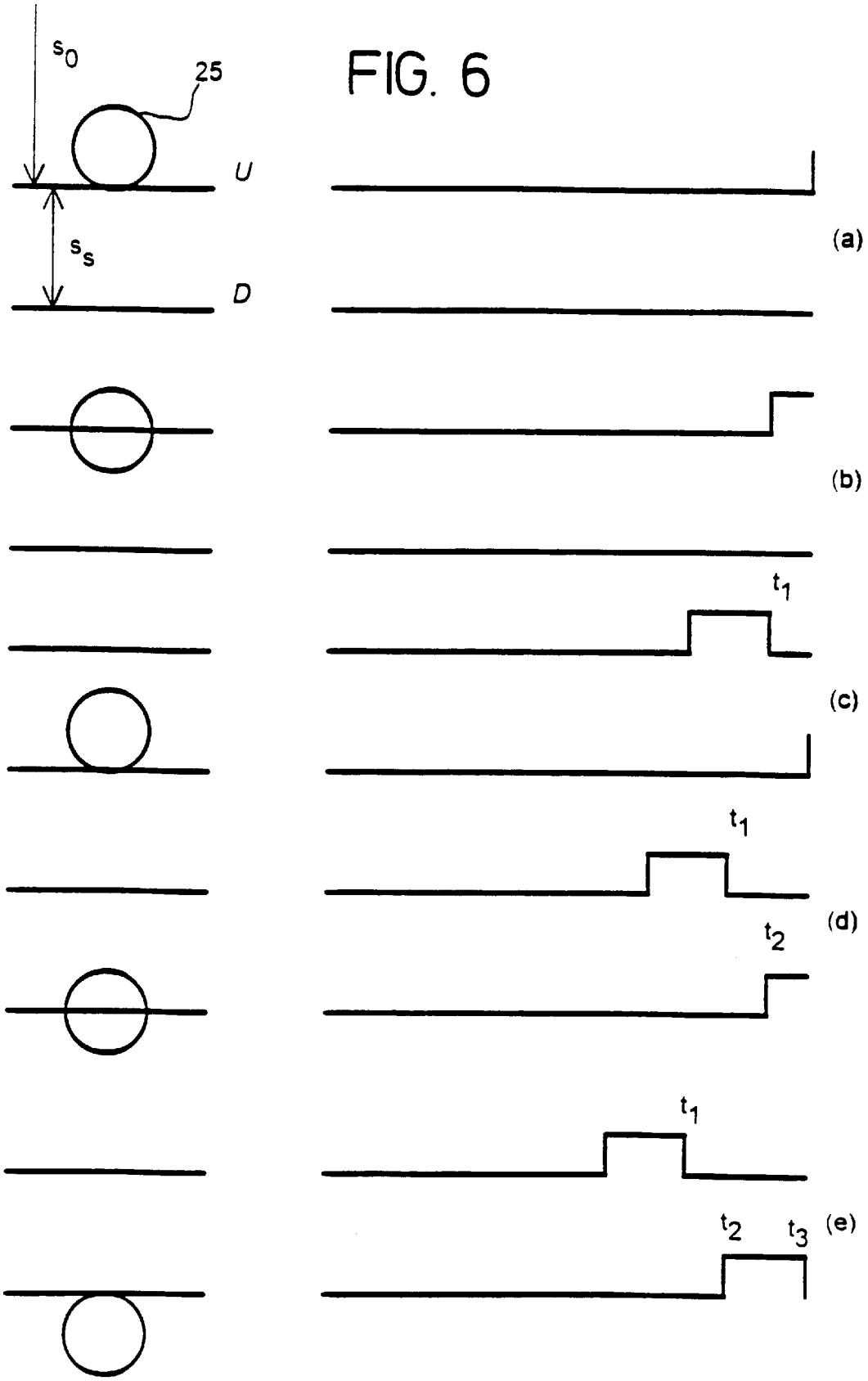
FIGS. 6*a* to 6*e* illustrate the passage of a small coin past the optical sensor stations of the validator of FIG. 1 operating according to the second embodiment of the present invention.
Figure 7:
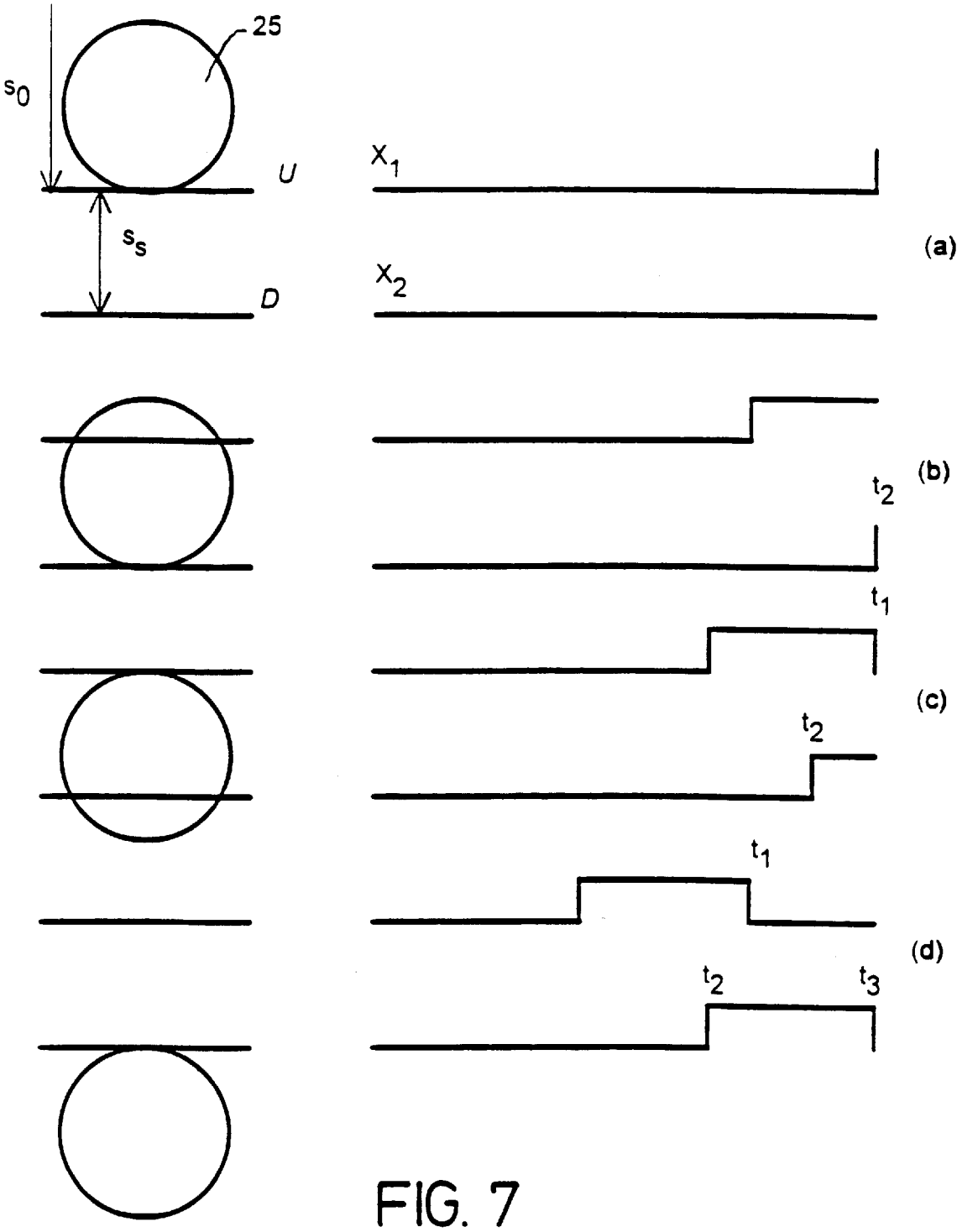
FIGS. 7*a* to 7*d* illustrate the passe of a large coin past the optical sensor stations of the validator of FIG. 1 operating according to the second embodiment of the present invention.

Referring to FIG. 5, the structure of the validator is substantially the same as that of FIGS. 1 and 2. However, the accept gate is now located in another unit (not shown). As a result there is a larger drop between the sensor stations 3 and the accept gate, giving more for the validity of a coin to be established. The electronic circuitry for this validator is as shown in FIG. 3. However, the EEPROM 19 will store a different program for the microprocessor, reflecting the different validation method.

Referring to FIG. 6*a*, a coin 25, entering the passageway 2 (FIG. 1), first intercepts the upstream beam U. When the incursion is detected, the state of signal $x_1$ changes. This change in state is not important for coin diameter determination but may conveniently be used as a wake up signal for the microprocessor 17.

Referring to FIG. 6*b*, as the coin continues to fall down the passageway 2, it continues to block the upstream beam U, at least partially, and the state of signal $x_1$ is maintained.

Referring to FIG. 6*c*, when the coin 25 leaves the upstream beam U, signal $x_1$ returns to its original value. This change of state is noted by the microprocessor 17 which stores a value $t_1$, representing the timing of the event. Shortly thereafter, the coin intercepts the downstream beam D, causing a change in state of signal $x_2$. This change of state is also noted by the microprocessor 17 which stores a value $t_2$ representing the timing of the event.

Referring to FIG. 6*d*, as the coin continues to fall down the passageway 2, it continues to block the downstream beam D, at least partially, and the state of signal $x_2$ is maintained.

Referring to FIG. 6*e*, as the coin leaves the downstream beam D, the signal $x_2$ returns to its original state. This change of state is noted by the microprocessor 17 which stores a value $t_3$ representing the timing of the event.

Thus, after a coin has passed both beams U, D, the microprocessor 17 has three values $t_1$, $t_2$ and $t_3$ from which to derive a value indicative of the diameter of the coin. If it is assumed that the velocity u of the coin through the sensing beams U,D, is constant, the distance s travelled by a coin in a given time is given by the formula:

$$s=ut \tag{1}$$

Since the distance $s_s$ between the beams is know and the time taken for the coin to travel that distance is known, i.e. the time between the coin leaving the upstream beam and the coin leaving the downstream beam, the velocity of the coin can be calculated. Thus, from (1):

$$u=S/t \tag{2}$$

Substituting $s_S$ for s and the measured times for t gives:

$$u = \frac{s_s}{(t_3 - t_1)} \tag{3}$$

Now, the upstream beam U is left when the coin has travelled a dance $s_0$ and the downstream beam is intercepted when the coin has travelled $s_0+s_1$ d, where d is the diameter of the coin. Thus, from (2) and (3) above:

$$s_0 = \frac{s_s}{(t_3 - t_1)} * t_1 \tag{4}$$

and $$s_0 + s_s - d = \frac{s_s}{(t_3 - t_1)} * t_3 \tag{5}$$

Subtracting (4) from (5) gives:

$$s_s - d = \frac{s_s}{(t_3 - t_1)} * (t_2 - t_1) \tag{6}$$

Since $s_1$ is a constant, only $$\frac{(t_2 - t_1)}{(t_3 - t_1)} \tag{7}$$

need be calculated in order to characterise a coin by its diameter.

Referring to FIGS. 7*a* to 7*d,* it can be seen that the coin 25 intercepts the downstream beam D before it clears the upstream beam U. This means that $t_2$ is before $t_1$. Although this produces a negative result when (7) is evaluated, no problem arises because, as can be seen from (6), the negative sign merely indicates that the diameter of the coin is greater than the spacing between the beams. Therefore, the result of the evaluation of (7) for a large coin still charcterises the coin by its diameter.

A third embodiment of the present invention will now be described with reference to FIGS. 8, 9, 10, 11*a* to 11*e* and 12*a* to 12*h,* wherein like parts have the same reference signs as in FIGS. 1 to 7.

Figure 8:
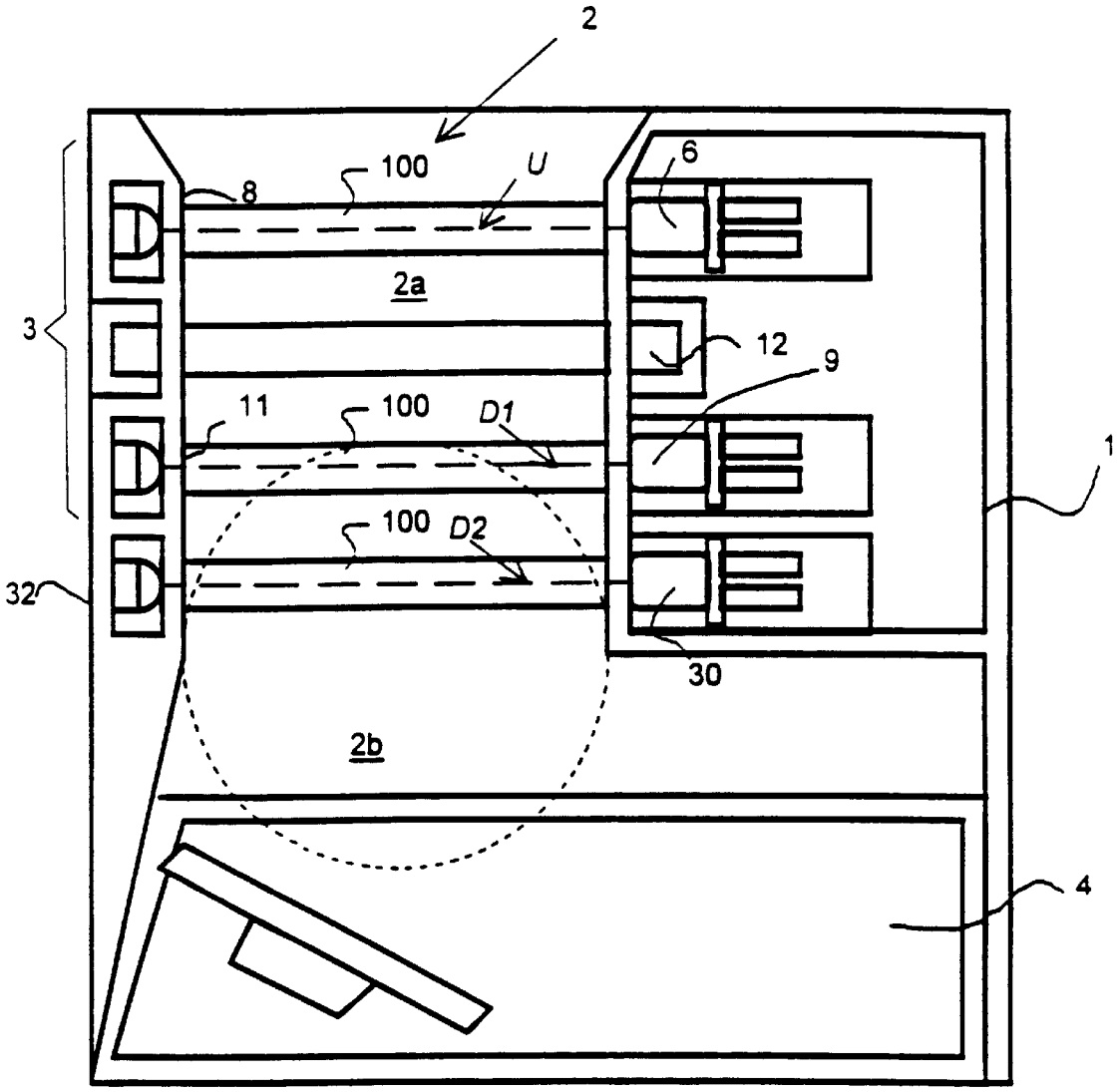
FIG. 8 shows a validator according to a third embodiment of the present invention with its front cover removed.
Figure 9:
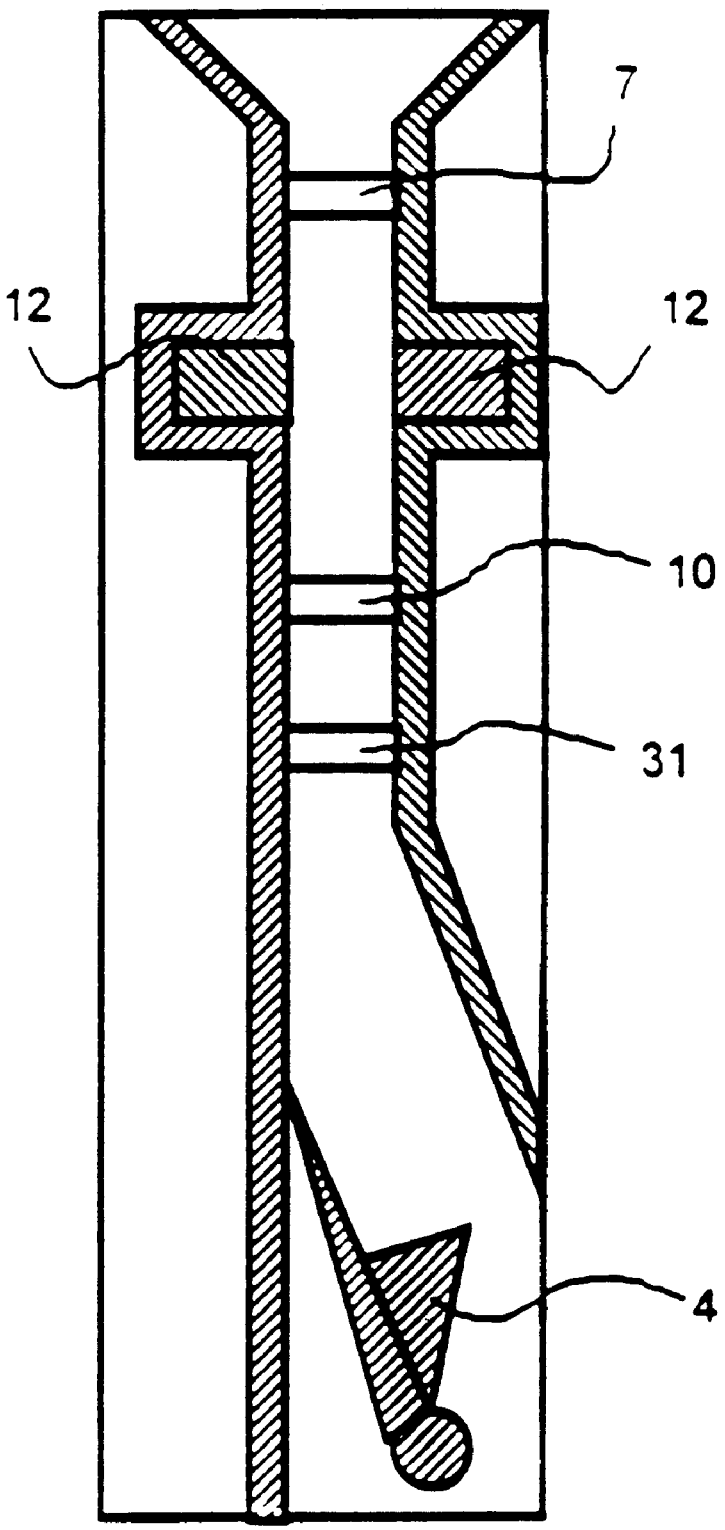
FIG. 9 is a sectional view along A—A or the validator of FIG. 8.

Referring to FIGS. 8 and 9, a further downstream optical sensor station, comprising a LED 30, a slit 31 and a photosensor 32, is provided.

Figure 10:
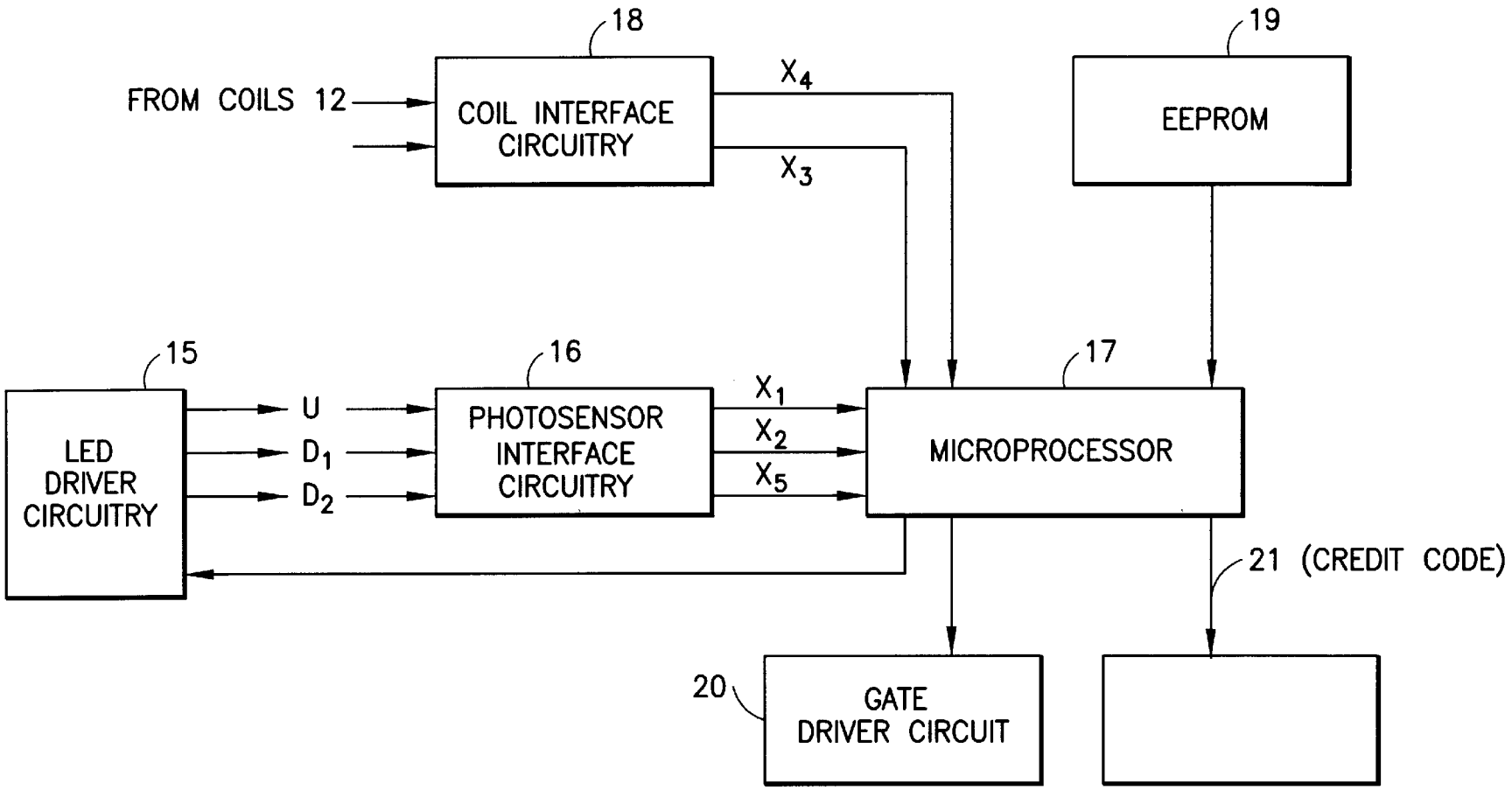
FIG. 10 is a block diagram of the electronic circuit of the validator of FIG. 8.
Figure 11:
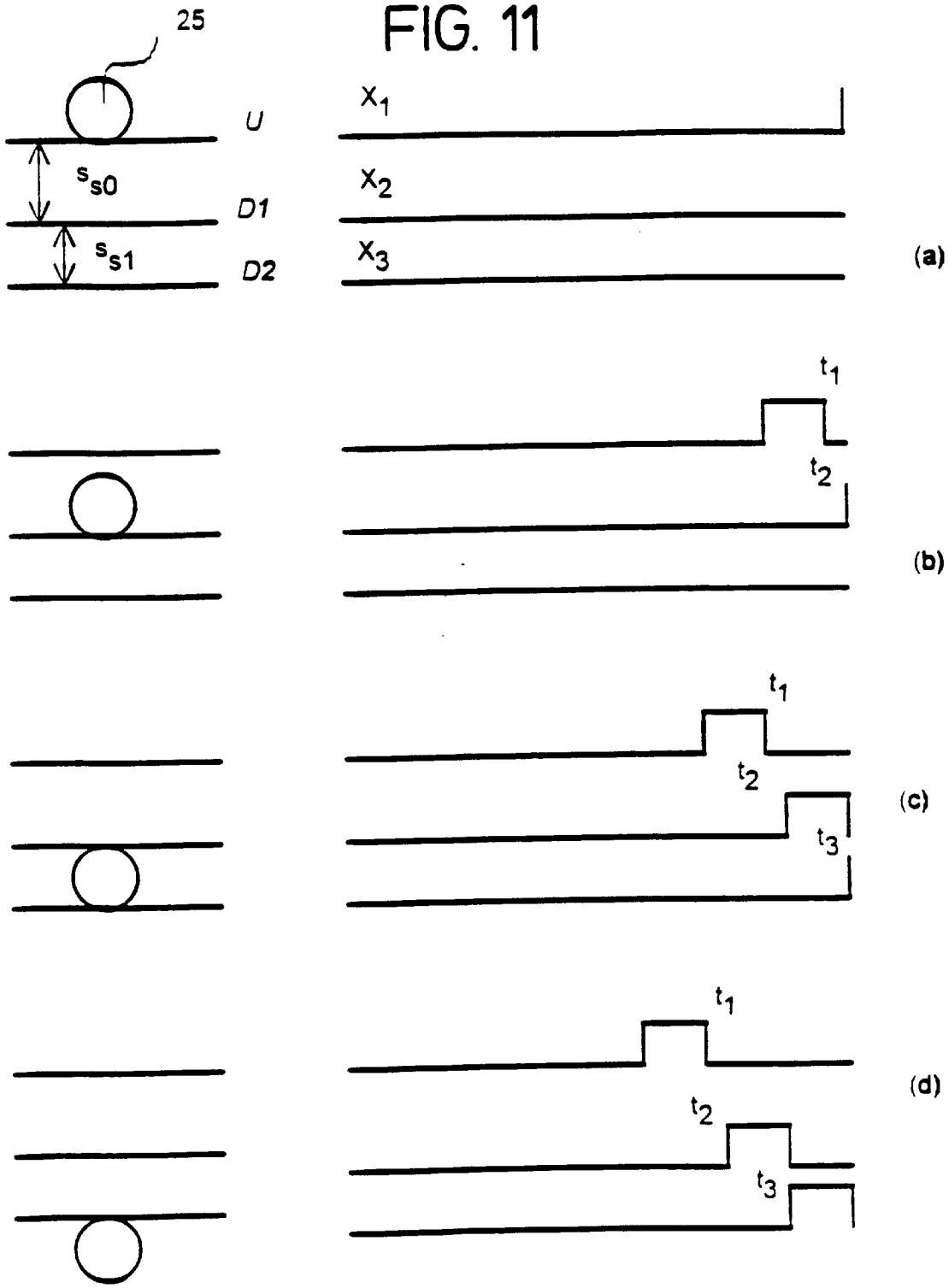
FIGS. 11*a* 11*d* illustrate the passage of a small coin past the optical sensor stations of the validator of FIG. 8 operating according to the third embodiment of the present invention.
Figure 12:
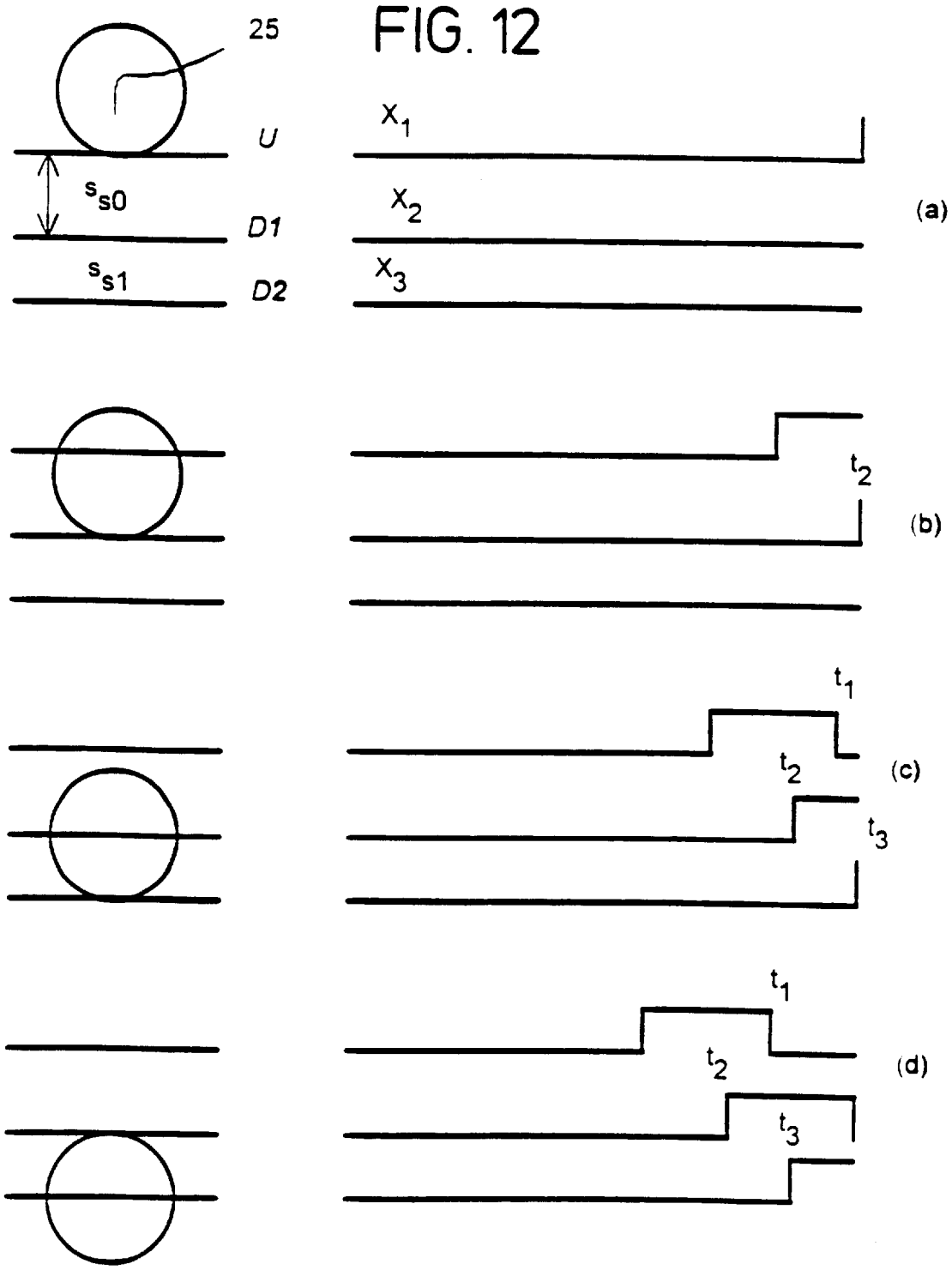
FIGS. 12*a* to 12*e* illustrate the passage of a large coin past the optical sensor stations of the validator of FIG. 8 operating according to the third embodiment of the present invention.

Referring to FIG. 10, the electronic circuitry is substantially the same as that of the first embodiment, described above, the main differences being in the program stored in the EEPROM 19. However, the LED driving circuitry 15 is adapted to drive three LEDs 5,7,30, and the photosensor interface circuitry 16 is adapted to process the signals from three photosensors 6,8,31 and output an additional signal $x_3$.

The operation of the validator known in FIGS. 8 and 9 will now be described. However, the details of the tests relying on the coils will be omitted as suitable techniques are well known in the art.

Referring to FIG. 11*a,* a coin 25, entering the passageway 2 (FIG. 8), first intercepts the upstream beam U. When the incursion is detected, the state of signal $x_1$ changes. This change in state is not important for coin diameter determination but may conveniently be used as a wake up signal for the microprocessor 17.

Referring to FIG. 11*b,* as the coin 25 continues to fall down the passageway 2, it continues to block the upstream beam U, at least partially, and the state of signal $x_1$ is maintained until the coin 25 leaves the upstream beam U, when of signal $x_1$ returns to its original value. This change of state is noted by the microprocessor 17 which stores a value $t_1$ representing the timing of the event. Shortly thereafter, the coin intercepts the first downstream beam D1, causing a change in state of signal $x_2$. This change of state is also noted by the microprocessor 17 which stores a value $t_2$ representing the timing of the event.

Referring to FIG. 11*c,* as the coin continues to fall down the passageway 2, it continues to block the first downstream beam D1, at least partially, and the state of signal $x_2$ is maintained. Next, the coin 25 intercepts the second downstream beam D2, causing a change in state of signal $x_3$. This change of state is noted by the microprocessor 17 which stores a value $t_3$ representing the timing of the event.

Finally, referring to FIG. 11*e,* as the coin 25 leaves each of the downstream beams D1,D2, the corresponding signals $x_2$, $x_3$ return to their original states.

In the second embodiment, described above, the speed corrosion is performed on the basis of the timings of the coin 25 leaving the two beams U,D. This has a disadvantage in that it limits the time available, before the coin reaches the accept gate 4, for performing the validation calculations. The present embodiment solves this problem by means of the second downstream beam D2 which enables the coin's speed to be determined earlier because the interception of the downstream beams D1,D2 by the leading edge of the coin is detected for this purpose. Thus, the speed of a coin can be determined before it has past the second downstream beam D2.

Now, since the speed correction is based upon the time taken for the leading edge of the coin to travel the distance $s_{s1}$ between the downstream beams D1,D2, equation (6) above becomes:

$$s_{s0} - d = \frac{s_{s1}}{(t_3 - t_2)} * (t_2 - t_1) \text{ or } s_{s0} + s_{s1} - d = \frac{s_{s1}}{(t_3 - t_2)} * (t_3 - t_1) \tag{8}$$

where $_{s0}$ is the distance between the upstream beam U and the first downstream beam D1.

Thus, since $s_{s0}$ and $s_{s1}$ are constants, a coin can be characterised on the basis of its diameter by evaluating:

$$\frac{(t_2 - t_1)}{(t_3 - t_2)} \text{ or } \frac{(t_3 - t_1)}{(t_3 - t_2)} \tag{9}$$

Referring to FIGS. 12*a* to 12*h,* it can be seen that $t_2$ occurs before $t_1$. If the first form of (9) is used a negative result will be obtained. However, as with the case of a large coin in a validator according to the second embodiment, the negative sign does not effect the validity of the characterisation of the coin by its diameter.

An advantage of the above-described embodiments is that the beams can be positioned such that for coin of interest, the processing means receives all the timing information within a window which is short compared with the time required for a coin to fall through the sensor stations.

The coils 12, employed in the validators of FIGS. 1, 2, 5, 8 and 9, will now be described in detail.

Figure 13:
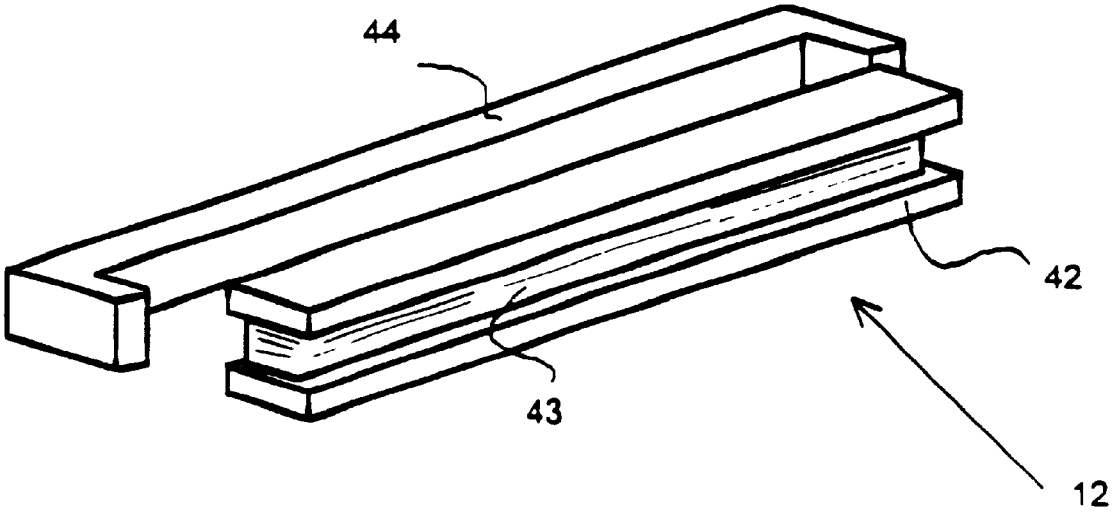
FIG. 13 is an exploded view of a sense coil.

Referring to FIG. 13, a coil 12 comprises an elongate, I-section former 42 about which the winding 43 is wound. The former 42 is formed from a high permeability material such as sintered ferrite or iron bonded in a polymer, for example 91% oxidised iron bonded in a polymer. Thus, the former 42, if it is non-conducting, can serve both as a core and as a bobbin onto which the winding 43 is wound directly.

An electromagnetic shield 44 comprises an elongate member having a flange extending perpendicularly at each end. The shield 44 is arranged to be attached to the coil 12 such that the winding 43 is wholly covered along one long side of the former 42 by the elongate member and at least partially covered at the ends of the former 42. The purpose of the shield 44 is to increase the Q of the coil 12 but also reduces both the susceptibility of the coil 40,41 to electromagnetic interference (EMI) and the electromagnetic energy emanating from the coil, other than into the coin passageway 2 (FIG. 1) of the validator.

Figure 14:
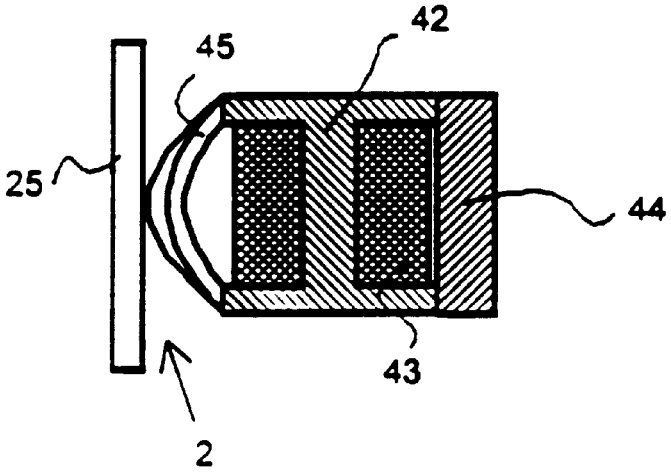
FIG. 14 is a sectional view of a sense coil as shown in FIG. 13.

Referring to FIG. 14, when a coil 12 is energized, a magnetic field 45 is projected into the coin passageway 2, between primarily the upper and lower cross-pieces of the I-section former 42. A coin 25 passing along the passageway 2 interacts with the projected magnetic field 45 varying the apparent impedance of the coil 12.

In the foregoing embodiments of the present invention, the diameter of a coin is determined by the optical sensor stations as described above. At the same time, one or more of the coils 12 are energized as set out in our European patent application publication no. 0 599 844. The effects of the coin 25 interacting with the magnetic field 45 are detected by the coil interface circuitry 18 which outputs signals $x_3$, $x_4$ to the microprocessor 17. The microprocessor 17 then determines whether the coin under test is valid on the basis of the signals $x_1$, $x_2$ x, generated by the optical sensing process and the signals $x_3$, $x_4$ generated by the inductive sensing process. If the coin is valid the microprocessor 17 sends a signal to the gate driver 20 to cause the accept gate 4 to open.

The microprocessor 17 carries out a validation process on the basis of the signals $x_1$, $x_2$, $x_3$, $x_4$ under the control of a program, stored in an EEPROM 19.

If as a result of the validation processes performed by the microprocessor 17, the coin is determined to be a true coin, a signal is applied to a gate driver circuit 20 in order to operate the accept gate 4 (FIG. 1) so as to allow the coin to follow the accept path A. Also, the microprocessor 17 provides an output on line 21, comprising a credit code indicating the denomination of the coin.

Referring to FIGS. 1, 5 and 8, reflective strips 100 are provided on the walls of the passageway 2 between each of the LEDs 6,9,30 and the corresponding photosensors 8,11, 32. The reflective strips 100 increase the light intensity at the photosensors 8,11,32 in the absence of a coin by reducing the amount of light absorbed by the wills of the passageway. As a result, the reduction in light intensity at the photosensors 8,11,32, due to the passage of a coin, is more profound than would be the case without the reflective strips 100. This makes it easier to detect accurately the edges of passing coins.

The reflective strips 100 also solve the problem of the LEDs 6,9,30 not directing light directly across the coin passageway making the apparatus much less sensitive to the orientation of the LEDs 6,9,30 and the direction in which light is actually emitted therefrom. In the absence of the reflective strips 100, misaligned LEDs result in regions of the passageway 2 which are not illuminated. If a coin passes through one of these regions, it will not affect the light intensity at the relent photosensor 8,11,32.

The reflective strips 100 may be, for example, painted onto the walls of the passageway 2 with metallic paint or formed from metal foil stuck to the walls of the passageway 2.

A fourth embodiment of the present invention will now be described with reference to FIGS. 15 and 16, wherein like parts have the same reference signs as in FIGS. 1 and 2. Since, the coils, described above with reference to FIGS. 13 and 14, are narrow in the direction of coin travel, it is possible to fit a plurality of them along the upper part of the coin passageway 2*a*. Consequently, it is possible to use coils, substantially as described, as sensors for determining the diameter of a coin under test.

Figure 15:
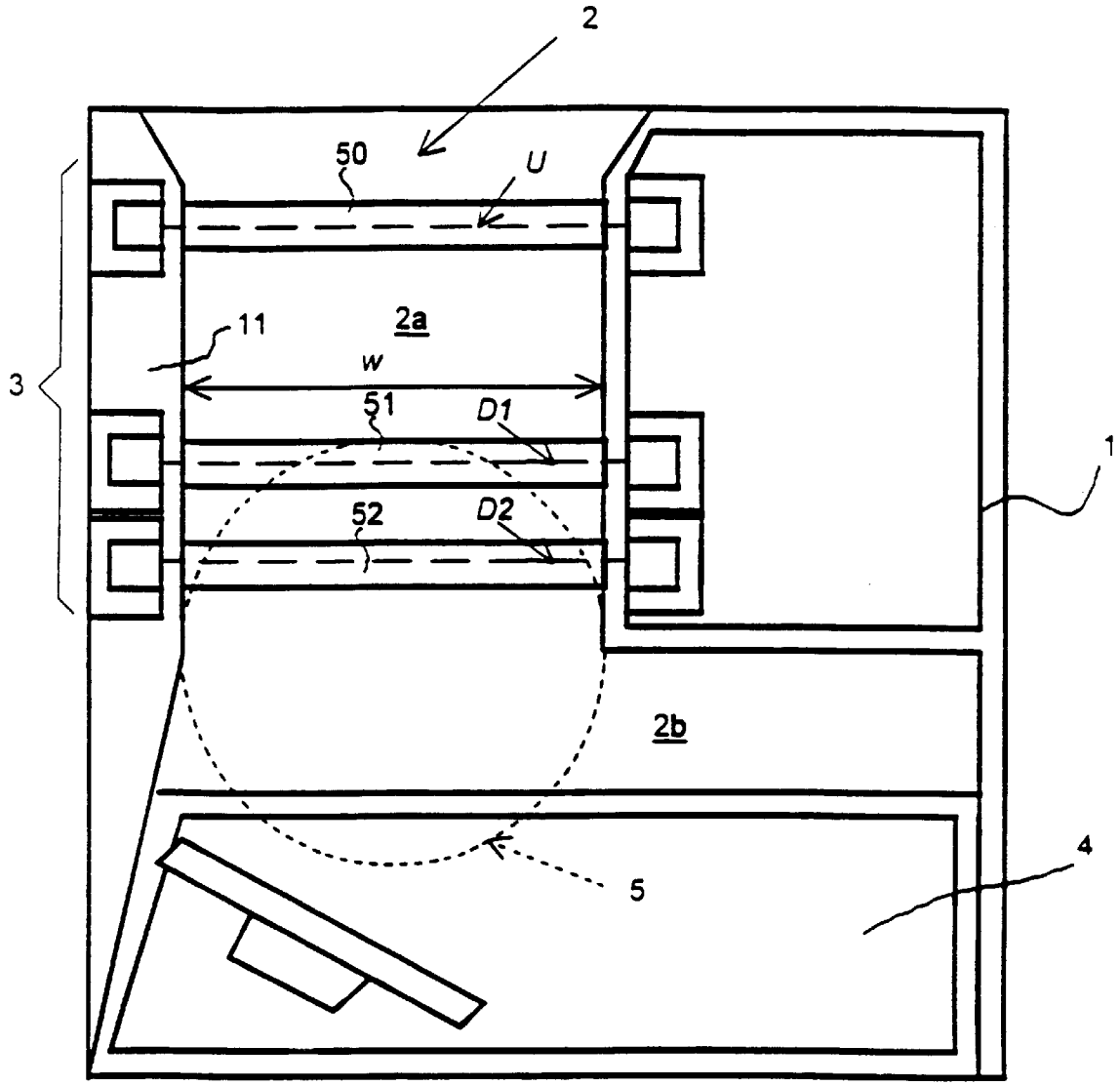
FIG. 15 shows a validator according to a fourth embodiment of the present invention.

Referring to FIG. 15, a validator is substantially as described with reference to FIG. 8. However, the coils 12 and the optical sensor stations have been replaced by three coil pairs 50,51,52, (one coil of each pair not shown) located at positions corresponding to those of the optical sensor stations shown in FIG. 8.

Figure 16:
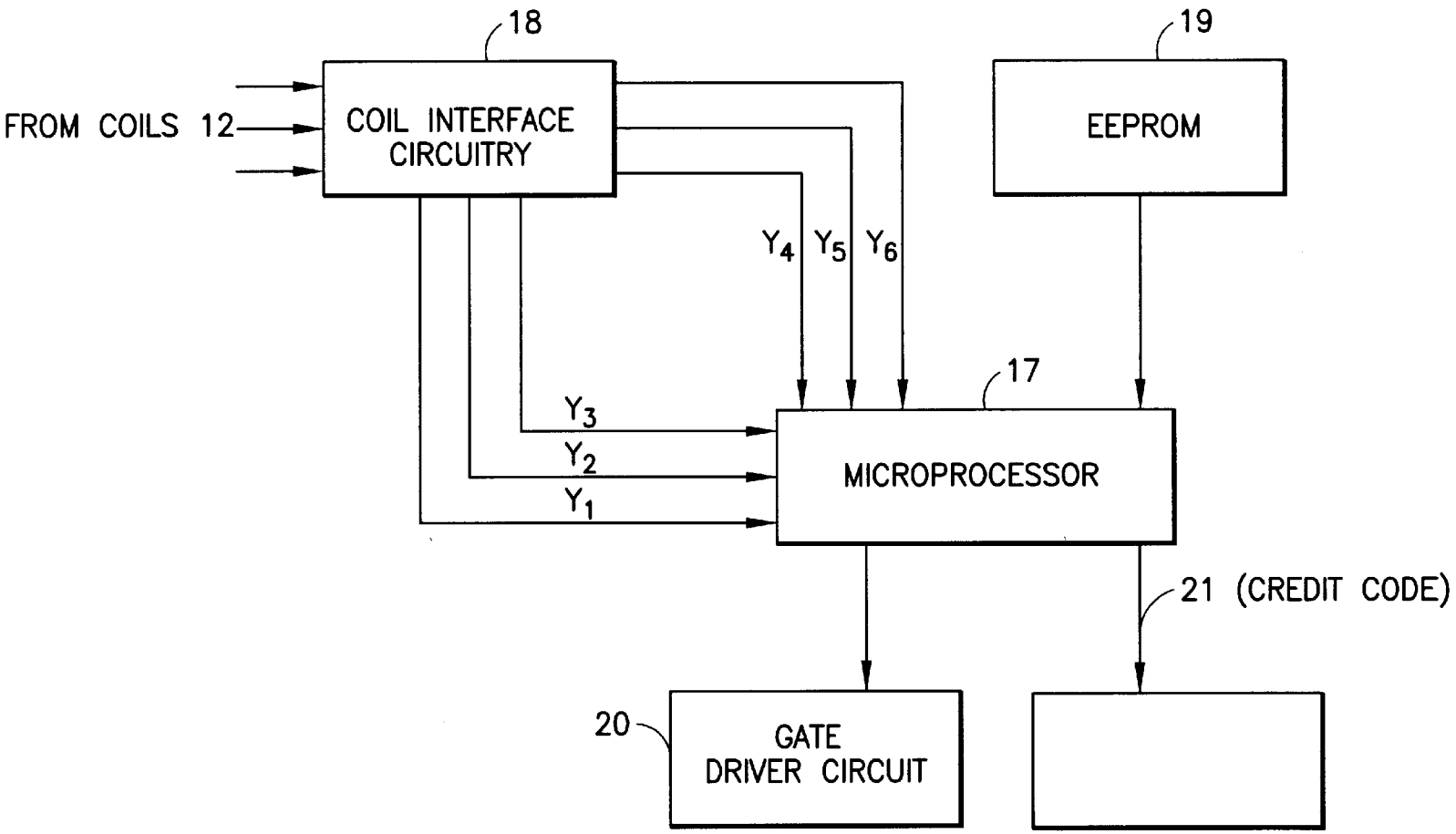
FIG. 16 is a block diagram of the electronic circuit of the validator of FIG. 15.

Referring to FIG. 16, a coil interface circuit 18 energizes the coil pairs 50,51,52 and processes the apparent impedance changes, caused by a passing coin, to produce six signals $y_1$, $y_2y_3$, $y_4$, $y_5$, $y_6$. The signals $y_4$, $y_5$, $y_6$ are conventional coin characteristic data signals and are fed to a microprocessor 17 for determination of coin characteristic such as material and thickness. The coil interface circuit 18 includes comparators for comparing the outputs of, at least, one coil 50,51,52 of each pair with a threshold.

As a coin passes each of the coil pairs 50,51,52, the amplitude of the respective coil signal first falls and then rises. As these signals cross the threshold, the outputs of the respective comparators change state, producing pulse signals which are similar to those shown in FIGS. 11 and 12. A diameter value for the coin can then be determined according to equation (9) above. However, as the coil signals depend on the material, and sometimes the thickness of the coin, the diameter value is for an apparent, or "electromagnetic", diameter.

For instance, a tin coin will appear to have a smaller "electromagnetic" diameter than a similarly sized coin made from ferromagnetic material. Nevertheless, the apparent diameter determined using equation (9) above will differ for differently sized coins of the same material.

In addition to monitoring the passage of coins into the validator, the signals from the coil pairs 50,51,52 are simultaneously used to derive additional information about a coin under test, including the nature of the material of the coin. For instance, one pair of coils may be driven in-phase and another in anti-phase or one coil pair could be switched between in-phase and anti-phase configurations. Once the nature of the material is known, it is possible to correct the "electromagnetic" diameter to derive the coin's physical diameter. However, in practice this is not necessary because, for each coin to be accepted, the validator could store sets of data defining values indicative of valid coins. The stored data would include data representative of coin material thickness, and also the "electromagnetic" width. Thus, it is not necessary to determine the actual physical diameter of a coin under test but only the "electromagnetic" diameter for comparison with a value established empirically.

Figure 18:
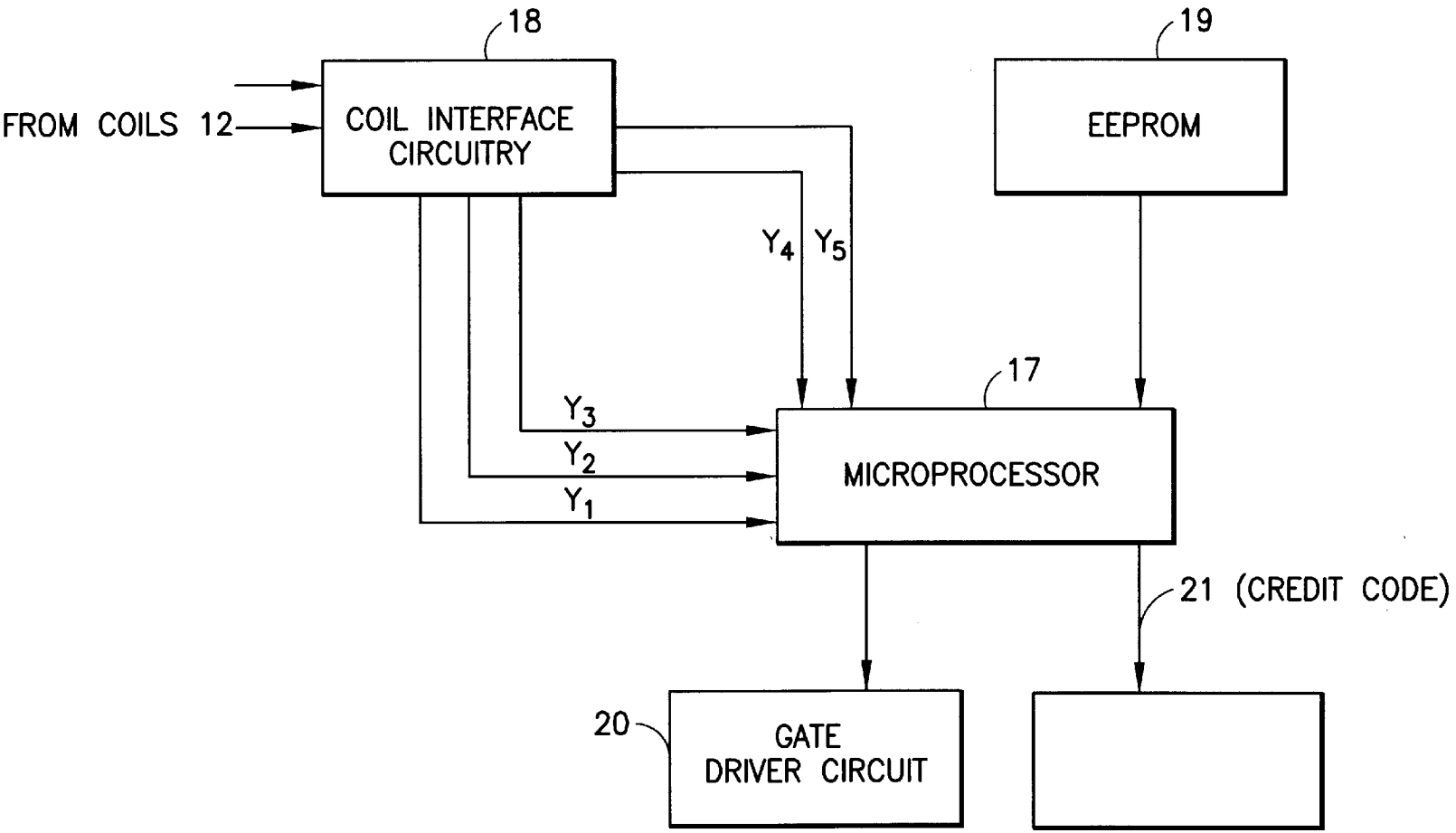
FIG. 18 is a block diagram of the electronic circuit of the validator of FIG. 17.
Figure 19:
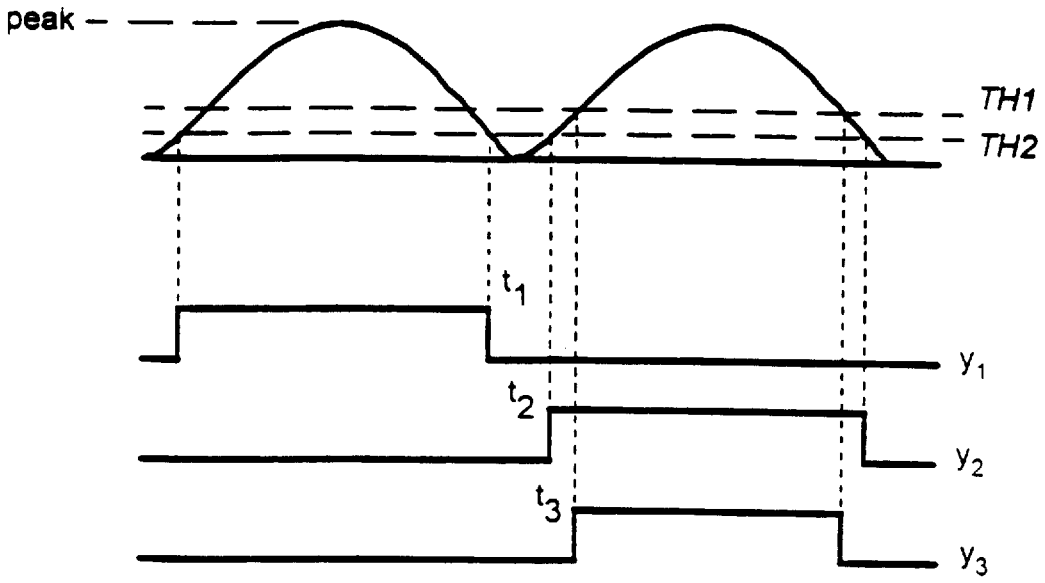
FIG. 19 illustrates signals produced by the interface circuit of FIG. 18.

A fifth embodiment of the present invention will now be described with reference to FIGS. 17, 18 and 19, wherein like parts have the same reference signs as in FIGS. 1, 2 and 15.

Figure 17:
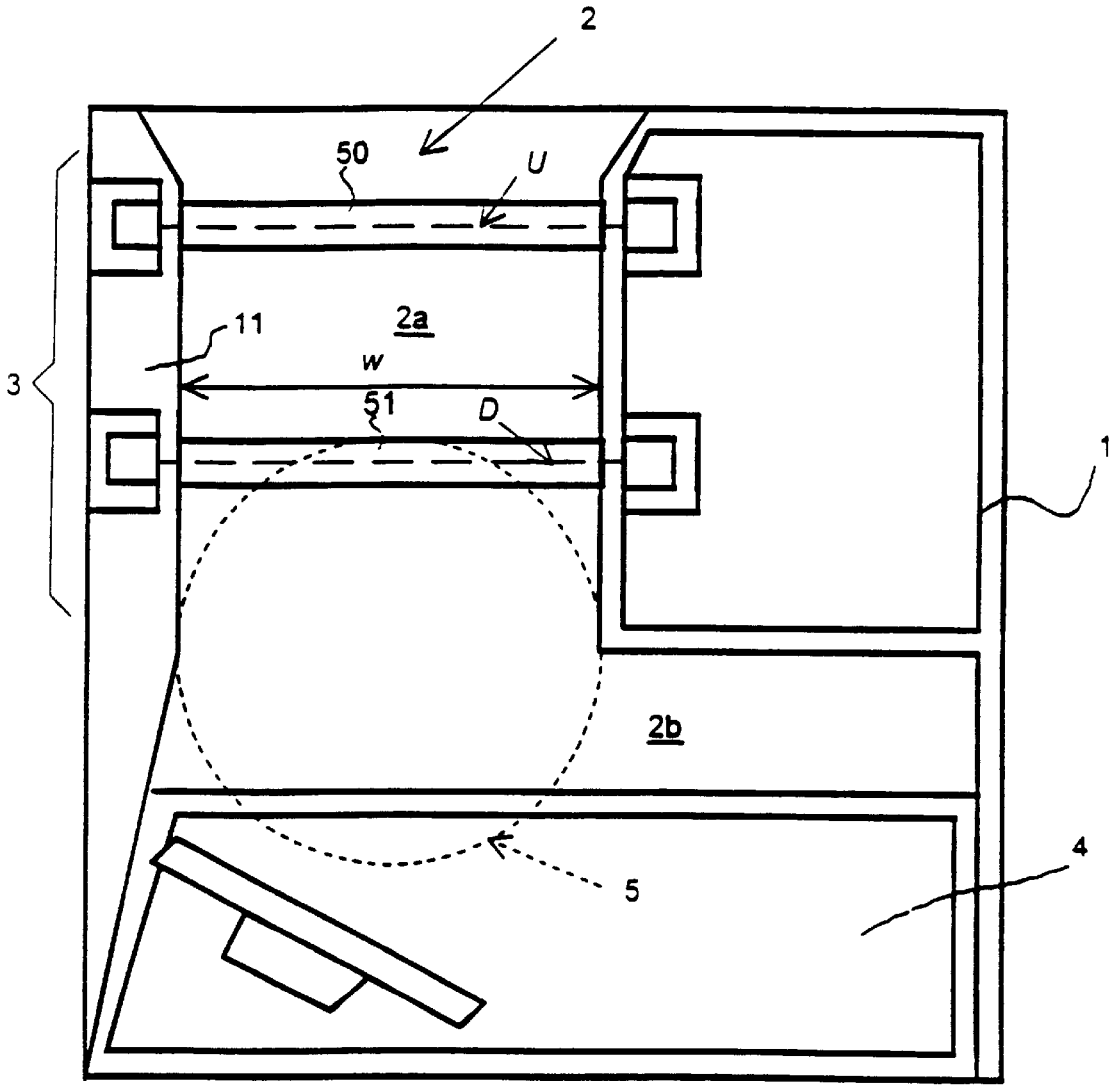
FIG. 17 shows a validator according to a fifth embodiment of the present invention.

Referring to FIG. 17, the validator is substantially the same as that shown in FIG. 15 but with the lowest coil omitted. The circuit arrangement (FIG. 18) of this embodiment is simmer to that shown in FIG. 16. However, as there are only two coils there are only two conventional coin characteristic signal lines $y_4$, $y_5$. Three diameter determining sign lines $y_1$, $y_2$, $y_3$ are retained but signal $y_3$ is derived differently and the operation of the microprocessor 17 altered in consequence.

The derivation of the signals $y_1$, $y_2$, $y_3$ will now be described with reference to FIG. 19. As a coin passes the upper coil 50, the amplitude of the respective coil signal rises to a peak and then falls again. The coil interface circuit 18 compares the signal for the upper coil 50 with a first threshold TH1 and outputs a pulse signal $y_1$ when the coil signal is over the threshold TH1. The microprocessor 17 detects the falling edge of the pulse signal $y_1$ and stores the time $t_1$. As the coin passes the lower coil 51, the amplitude of the respective coil signal rises to a peak and then falls again. The coil interface circuit 18 compares the signal with both the first threshold TH1 and a second higher threshold TH2. A pulse signal $y_2$ is output when the coil signal is over the first threshold TH1 and a pulse signal $y_3$ when the coil signal is over the second threshold TH2.

As described above, the time difference $t_2-t_1$ is dependent on the diameter of a coin under test but in order to obtain a meaningful value, a correction must be made to take account of the velocity of the coin. In the present embodiment, the coin's velocity is derived from the time difference $t_3-t_2$. This time difference depends on the peak coil signal which is indicative of the material from which the coin is formed. However, the peak coil signal is available as part of the conventional inductive testing and can be used to select a predetermined correction factor. It should be borne in mind that correction factors are required only where the materials and/or thickness indicates that the coin may be acceptable.

Another sensor, suitable for use in place of the optical and inductive sensors used in the foregoing embodiments, will now be described with reference to FIGS. 20 and 21.

Figure 20:
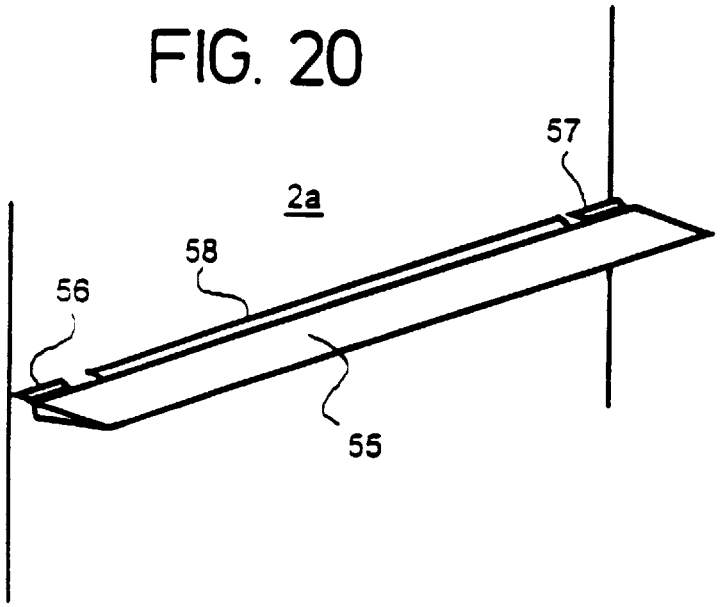
FIG. 20 shows a piezo-electric sensor suitable for use instead of the optical sensors used in the validators of FIGS. 1, 5 and 8.

Referring to FIG. 20, a sensor comprises a flap 55 extending across the depth b of the upper part 2*a* of the coin passageway from the back wall thereof. The flap 55 also extends across the full width of the upper part 2*a* of the coin passageway. The flap 55 is pivotably mounted to the back wall of the coin passageway by a pair of spaced light leaf springs 56,57. A piezo-electric film 58 extends from the flap 55 to the back wall of the coin passageway between the leaf springs 56,57. The film 58 may be polyvinylidene fluoride (PVDF) sold by AMP under the trade mark Kynar*.

Figure 21:
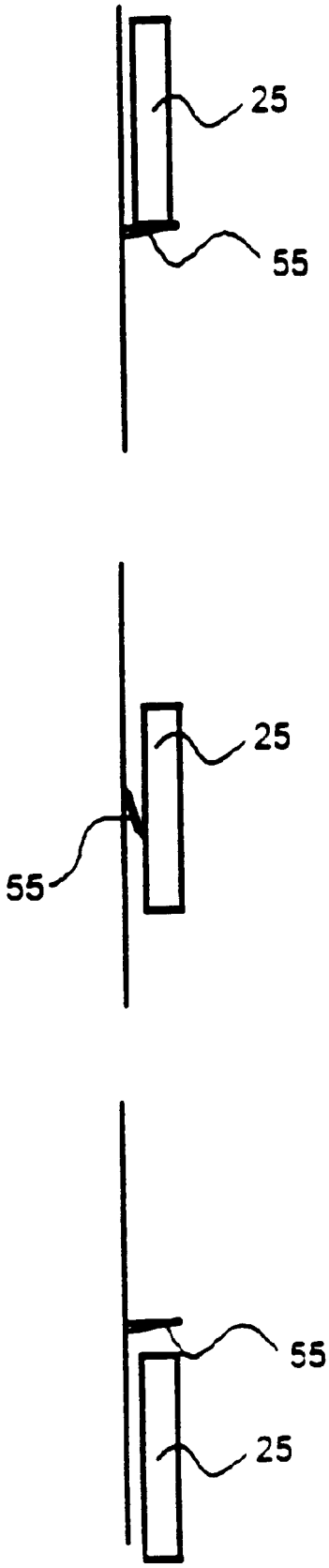
FIG. 21 shows the passage of a coin past a sensor as shown in FIG. 20.

Referring to FIG. 21, as a coin 25 travels down the coin passageway it hits the flap 55 causing it to pivot downwardly against the leaf springs. The pivoting of the flap 55 stresses the piezo-electric film 58 which generates an electrical signal. This electric signal continues to be produced as long as the flap 55 is displaced from its rest position. Once the coin 25 has passed the flap 55, the leaf springs return it to its rest position, relieving the stress in the piezo-electric film 58 and terminating the electric signal.

It will be appreciated that the duration of the electric signal produced by the piezo electric film 58 will be dependent on the coin diameter, the speed of the coin and the length of the flap 55, perpendicular to the back wall of the coin passageway. Consequently, the equations given above will need to be modified to take this into account. However, since the length of the flap is known, the necessary modifications will be readily apparent to the skilled person.

A modification whereby the depth of the coin passageway can be varied will now be described with reference to FIG. 22, wherein like parts have the same reference signs as in FIGS. 1 and 2.

Figure 22:
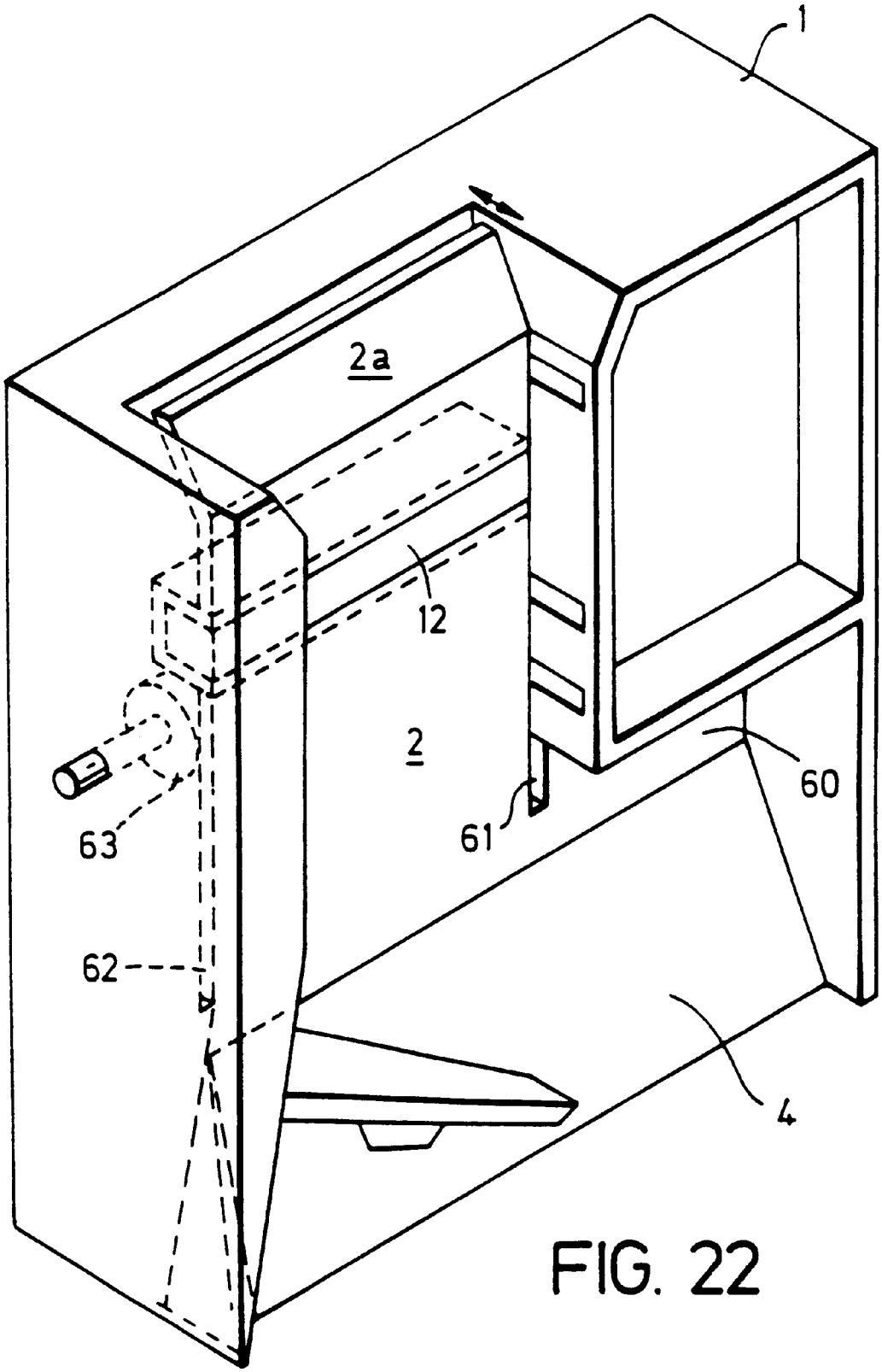
FIG. 22 shows a modification applicable to the validators of FIGS. 1, 5, 8, 15 and 17.

Referring to FIG. 22, the element 60 forming the back wall of the coin passageway 2 is provided with a pair of vertical slots 61,62. One slot 61,62 is provided on each side of the upper portion 2, of the coin passageway 2. Since, the element 60 is formed of plastics material, the back wall of the upper portion 2*a* of the passageway 2 is able to bend to and fro about a line joining the bottoms of the slots 61,62.

A cam 63 is mounted behind the element 60 and bears against the back wall of the passageway 2. The cam 63 can be rotated which causes the back wall of the upper passageway portion 2*a* to be moved to and fro (as indicated by the double headed arrow in FIG. 22), thereby altering the depth b (as indicated in FIG. 2) of the upper portion 2*a*. The bearing surface of the cam 63 is formed as a plurality of elongate flats so that the cam 63 will not be turned by a force applied to the back wall of the upper passageway portion 2*a*. In use, the cam 63 is rotated into a position which sets the depth b of the upper passageway portion 2*a* to be appropriate for the coins for which the validator is designed. Thereafter, the cam 63 is not moved unless the validator is to be used with a different coin set. In the embodiment shown in FIG. 19, the coil 12 is mounted to the moveable part of the element 60 and is dimensioned such that it does not extend beyond the slots 61,62. This means that the coil 12 is kept as close as is possible to coins travelling through the passageway 2 whatever the position of the cam 63.

In the interests of clarity, only the optical, inductive and piezo-electric sensors particular to the present invention have been described. However, the skilled person will appreciate that additional sensors and/or anti-fraud devices, of which many are known in the art, could be used in addition to the sensors described above.

We claim:

1. A coin validation apparatus comprising:

means defining first and second reference lines spaced along a coin path by the diameter of the coin type to be accepted by the validator;

means defining a third reference line downstream of the first reference line by the diameter of a further coin type to be accepted by the validator;

sensor means for detecting a trailing point on a coin passing the first reference line and a leading point on the coin reaching the second reference line;

further sensor means for detecting a leading point on the coin reaching the third reference line; and processing means for checking the diameter of a coin under test on the basis of said trailing point passing the first reference line and said leading point reaching the second reference line, wherein the reference lines extend across the coin path so as to be parallel to a major face of a coin under test and the processing means checks the diameter of the coin under test without reference to said leading point reaching the first reference line, and the processing means is responsive to the further sensor means to produce a characterising signal for a coin under test on the basis of the time difference between the trailing point on the coin passing the first reference line and said leading point reaching the third reference line.

2. An apparatus according to claim 1, wherein said trailing and leading points are located substantially on the circumference of a coin.

3. An apparatus according to claim 1, wherein the sensor means comprises a beam of optical radiation crossing the coin path and a detector therefore for the first and second reference lines and the further sensor means comprises a beam of optical radiation crossing the coin path and a detector therefore for the third reference line.

4. An apparatus according to claim 3, including reflective means associated with walls of the coin path for ensuring the beam is present throughout the depth of the path where said beam crosses the coin path.

5. An apparatus according to claim 4, wherein the reflective means comprises a strip parallel to each said beam.

6. An apparatus according to claim 4, wherein the reflective means comprises a layer of reflective paint.

7. An apparatus according to claim 4, wherein the reflective means comprises a metallic film.

8. An apparatus according to claim 3, wherein the coin path has a breadth (b) to accommodate the thickness of a coin under test, a width (w) to accommodate the coin's diameter, and a length along which coins under test can pass edgewise, wherein the sensor means includes emitter means on one side of the passageway for directing said beams of optical radiation across the width of the passageway, and the detectors are opposite respective emitter means.

9. An apparatus according to claim 1, wherein the sensor means comprises inductive sensors.

10. An apparatus according to claim 9, wherein the coin path has a breath (b) to accommodate the thickness of a coin under test, a width (w) to accommodate the coin's diameter, and a length along which coins under test can pass edgewise, wherein the sensor means includes an elongate inductor arranged substantially parallel to the width direction of the path.

11. An apparatus according to claim 1, wherein the sensor means comprises a piezo-electric element associated with each reference line, the piezo-electric elements being arranged to be stressed by the passage of a coin to produce electric signals.

12. An apparatus according to claim 11, wherein at least one of the piezo-electric elements comprises a flap, arranged to stress a piezo-electric film as it is displaced by a passing coin.

13. A coin validation apparatus according to claim 1, wherein the coin path has a breadth to accommodate the thickness of a coin under test, a width to accommodate the coin's diameter, and a length along which coins under test can pass edgewise, and an inductive coin sensing station is provided between said first and second reference lines, the sensing station including a coil assembly beside the coin path and arranged to inductively couple with a major face of a coin therein, and such that the magnetic field produced thereby is substantially constant across the width of the coin path.

14. An apparatus according to claim 13, wherein the inductive coin sensing station comprises first and second coils opposite each other across the breadth of the coin path.

15. An apparatus according to claim 13, wherein the coil assembly comprises a coil wound in the form of an elongate oval or rectangle.

16. An apparatus according to claim 15, wherein the coil is wound on an elongate I-section former.

17. An apparatus according to claim 13, wherein the coil assembly includes a coil and shielding means to magnetically shield portions of the coil not immediately adjacent the coin path.

18. An apparatus according to claim 15, wherein the axis of the coil is parallel to the length direction of the coin path.

19. A coin validation apparatus comprising:

means defining first and second reference lines spaced along a coin path;

sensor means for detecting a trailing point on a coin passing the first reference line and a leading point on the coin reaching the second reference line;

means for determining a velocity dependent value for a coin passing the reference lines comprising:

means to define a third reference line downstream of the first reference line, and further sensor means for detecting said leading point reaching the third reference line; and processing means for checking the diameter of a coin under test on the basis of said trailing point passing the first reference line and said leading point reaching the second reference line, wherein the reference lines extend across the coin path so as to be parallel to a major face of a coin under test, and the processing means is responsive to said further sensor means to derive said velocity dependent value on the basis of the time difference between said leading point reaching the second reference line and said leading point reaching the third reference line, and checks the diameter of the coin under test in dependence on said velocity dependent value for a coin under test, without reference to said leading point reaching the first reference line.

20. An apparatus according to claim 19, wherein the processing means checks the diameter of the coin under test on the basis of the result of:

$$\frac{(t_1 - t_2)}{(t_3 - t_2)}$$

where:

$t_1$ is the time of the trailing point passing the first reference line, and $t_2$ and $t_3$ are the times of the leading point reaching the second and third reference lines respectively.

21. An apparatus according to claim 19, wherein said trailing and leading points are located substantially on the circumference of a coin.

22. An apparatus according to claim 19, wherein the sensor means comprises a beam of optical radiation crossing the coin path and a detector therefor for the first and second reference lines and the further sensor means comprises a beam of optical radiation crossing the coin path and a detector therefor for the third reference line.

23. An apparatus according to claim 22, including reflective means associated with walls of the coin path for ensuring the beams are present throughout the depth of the coin path where said beams cross the coin path.

24. An apparatus according to claim 23, wherein the reflective means comprises a strip parallel to each said beam.

25. An apparatus according to claim 23, wherein the reflective means comprises a layer of reflective paint.

26. An apparatus according to claim 23, wherein the reflective means comprises a metallic film.

27. An apparatus according to claim 19, wherein the coin path has a breadth to accommodate the thickness of a coin under test, a width to accommodate the coin's diameter, and a length along which coins under test can pass edgewise, wherein the sensor means includes emitter means on one side of the passageway for directing said beams of optical radiation across the width of the passageway, and the detectors are opposite respective emitter means.

28. An apparatus according to claim 19, wherein the sensor means comprises inductive sensors.

29. An apparatus according to claim 28, wherein the coin path has a breadth to accommodate the thickness of a coin under test, a width to accommodate the coin's diameter, and a length along which coins under test can pass edgewise, wherein the sensor means includes an elongate inductor arranged substantially parallel to the width direction of the path and having its winding axis substantially parallel to the direction of travel of coins along the path.

30. An apparatus according to claim 19, wherein the sensor means comprises a piezo-electric element associated with each reference line, the piezo-electric elements being arranged to be stressed by the passage of a coin to produce electric signals.

31. An apparatus according to claim 30, wherein at least one of the piezo-electric elements a flap, arranged to stress a piezo-electric film as it is displaced by a passing coin.

32. An apparatus according to claim 19, wherein the coin path has a breadth to accommodate the thickness of a coin under test, a width to accommodate the coin's diameter, and a length along which coins under test can pass edgewise, and an inductive coin sensing station is provided between said first and second reference positions, the sensing station including a coil assembly beside the coin path and arranged to inductively couple with a major face of a coin therein, and such that the magnetic field produced thereby is substantially constant across the width of the coin path.

33. An apparatus according to claim 32, wherein the inductive coin sensing station comprises first and second coils opposite each other across the breadth of the coin path.

34. An apparatus according to claim 33, wherein the coil assembly comprises a coil wound in the form of an elongate oval or rectangle.

35. An apparatus according to claim 34, wherein the coil is wound on an elongate I-section former.

36. An apparatus according to claim 34, wherein the coil assembly includes a coil and shielding means to magnetically shield portions of the coil not immediately adjacent the coin path.

37. An apparatus according to claim 34, wherein the axis of the coil is parallel to the length direction of the coin path.

38. An apparatus according to claim 19, wherein the coin path is vertical.

39. A coin validation apparatus comprising:

coin path having a breadth to accommodate the thickness of a coin under test, a width to accommodate the coin's diameter, and a length along which coins under test can pass edgewise, means defining first and second reference positions spaced along said coin path by the diameter of a coin type to be accepted by the validator, means defining a third reference position downstream of the first reference position by the diameter of a further coin type to be accepted by the validator, optical sensor means for detecting a trailing point on a coin passing the first reference position and a leading point on the coin reaching the second reference position, further optical sensor means for detecting a leading point on the coin reaching the third reference position, and processing means for checking the diameter of a coin under test on the basis of said trailing point passing the first reference position and said leading point reaching the second reference position, wherein the sensor means and the further sensor means each comprise an emitter means on one side of the coin path for directing beams of optical radiation across the width of the coin path and a detector opposite the emitter means, the processing means is responsive to the further optical sensor means to produce a characterising signal for a coin under test on the basis of the time difference between the trailing point on the coin passing the first reference position and said leading point reaching the third reference position, and the processing means checks the diameter of the coin under test without reference to said leading point reaching the first reference position.

40. An apparatus according to claim 39, wherein said trailing and leading points are located substantially on the circumference of a coin.

41. An apparatus according to claim 39, including reflective means associated with the major walls of the coin path for ensuring the beams are present throughout the depth of the path where said beams cross the coin path.

42. An apparatus according to claim 41, wherein the reflective means is a strip parallel to said beam.

43. An apparatus according to claim 41, wherein the reflective means comprises a layer of reflective paint.

44. An apparatus according to claim 41, wherein the reflective means comprises a metallic film.

45. An apparatus according to claim 39, including an inductive coin sensing station between said first and second reference positions, the sensing station including a coil assembly beside the coin path and arranged to inductively couple with a major face of a coin therein and such that the magnetic field produced thereby is substantially constant across the width of the coin path.

46. An apparatus according to claim 45, wherein the inductive coin sensing station comprises first and second coils opposite each other across the breadth of the coin path.

47. An apparatus according to claim 45, wherein the coil assembly comprises a coil wound in the form of an elongate oval or rectangle.

48. An apparatus according to claim 47, wherein the coil is wound on an elongate I-section former.

49. An apparatus according to claim 45, wherein the coil assembly includes a coil and shielding means to magnetically shield portions of the coil not immediately adjacent the coin path.

50. A coin validation apparatus according to claim 47, wherein the axis of the coil is parallel to the length direction of the coin path.

51. An apparatus according to claim 39, wherein the coin path is vertical.

52. A coin validation apparatus comprising:

coin path having a breadth to accommodate the thickness of a coin under test, a width to accommodate the coin's diameter, and a length along which coins under test can pass edgewise.

means defining first and second reference positions spaced along said coin path, optical sensor means for detecting a trailing point on a coin passing the first reference position and a leading point on the coin reaching the second reference position means for determining a velocity dependent value comprising:

means to define a third reference position downstream of the first reference position, and further optical sensor means for detecting said leading point reaching the third reference position, and processing means for checking the diameter of a coin under test on the basis of said trailing point passing the first reference position and said leading point reaching the second reference position and said velocity dependent value, wherein the sensor means and the further sensor means include emitter means on one side of the coin path for directing beams of optical radiation across the width of the coin path and detectors opposite respective emitter means, the processing means is responsive to said further sensor means to derive said velocity dependent value on the basis of the time difference between said leading point reaching the second reference position and said leading point reaching the third reference position, and the processing means checks the diameter of the coin under test without reference to said leading point reaching the first reference position.

53. An apparatus according to claim 52, wherein the processing means produces the characterising signal on the basis of the result of:

$$\frac{(t_1 - t_2)}{(t_3 - t_2)}$$

where:

$t_1$ is the time of trailing point passing the upper first reference position, and $t_2$ and $t_3$ are the times of the leading point reaching the second and third reference positions.

54. An apparatus according to claim 52, wherein said trailing and leading points are located substantially on the circumference of a coin.

55. An apparatus according to claim 52, including reflective means associated with the major walls of the coin path for ensuring the beam is present throughout the depth of the path where said beam crosses the coin path.

56. An apparatus according to claim 55, wherein the reflective means is a strip parallel to said beam.

57. An apparatus according to claim 55, wherein the reflective means comprises a layer of reflective paint.

58. An apparatus according to claim 55, wherein the reflective means comprises a metallic film.

59. An apparatus according to claim 52, including an inductive coin sensing station between said first and second reference positions, the sensing station including a coil assembly beside the coin path and arranged to inductively couple with a major face of a coin therein and such that the magnetic field produced thereby is substantially constant across the width of the coin path.

60. An apparatus according to claim 59, wherein the inductive coin sensing station comprises first and second coils opposite each other across the breadth of the coin path.

61. An apparatus according to claim 59, wherein the coil assembly comprises a coil wound in the form of an elongate oval or rectangle.

62. An apparatus according to claim 61, wherein the coil is wound on an elongate I-section former.

63. An apparatus according to claim 59, wherein the coil assembly includes a coil and shielding means to magnetically shield portions of the coil not immediately adjacent the coin path.

64. An apparatus according to claim 60, wherein the axis of the coil is parallel to the length direction of the coin path.

65. An apparatus according to claim 52, wherein the coin path is vertical.

66. A coin validation apparatus comprising means defining first and second reference positions spaced along a vertical coin path by the diameter of a first coin type to be accepted by the validator, sensor means for detecting a trailing point on a coin passing the first reference position and a leading point on the coin passing the second reference position, means defining a third reference position downstream of the first reference position by the diameter of a second coin type to be accepted, further sensor means for detecting a leading point on the coin reaching the third reference position, and processing means for checking the diameter of a coin under test on the basis of said trailing point passing the first reference position and said leading point reaching the second reference position and said third reference position, wherein the processing means checks the diameter of the coin under test without reference to said leading point reaching the first reference position.

67. An apparatus according to claim 66, wherein said trailing and leading points are located substantially on the circumference of a coin.

68. An apparatus according to claim 66, wherein the sensor means comprises a beam of optical radiation crossing the coin path and a detector therefore for each said reference position.

69. An apparatus according to claim 68, including reflective means associated with the major walls of the coin path for ensuring the beam is present throughout the depth of the path where said beam crosses the coin path.

70. An apparatus according to claim 69, wherein the reflective means is a strip parallel to said beam.

71. An apparatus according to claim 69, wherein the reflective means comprises a layer of reflective paint.

72. An apparatus according to claim 69, wherein the reflective means comprises a metallic film.

73. An apparatus according to claim 68, wherein the coin path has a breadth to accommodate the thickness of a coin under test, a width to accommodate the coin's diameter, and a length along which coins under test can pass edgewise, wherein the sensor means includes emitter means on one side of the coin path for directing said beams of optical radiation across the width of the coin path, and the detectors are opposite respective emitter means.

74. An apparatus according to claim 66, wherein the sensor means comprises inductive sensors.

75. An apparatus according to claim 74, wherein the coin path has a breadth to accommodate the thickness of a coin under test, a width to accommodate the coin's diameter, and a length along which coins under test can pass edgewise, wherein the sensor means includes an elongate inductor arranged substantially parallel to the width direction of the coin path.

76. An apparatus according to claim 66, wherein the sensor means comprises a piezo-electric element associated with each reference position, the piezo-electric elements being arranged to be stressed by the passage of a coin to produce electrical signals.

77. An apparatus according to claim 76, wherein at least one of the piezo-electric elements comprises a flap, arranged to stress a piezo-electric film as it is displaced by a passing coin.

78. An apparatus according to claim 68, including an inductive coin sensing station between said first and second reference positions, the sensing station including a coil assembly beside the coin path and arranged to inductively couple with a major face of a coin therein and such that the magnetic field produced thereby is substantially constant across the width of the coin path.

79. A coin validator according to claim 78, wherein the inductive coin sensing station comprises first and second coils opposite each other across the breadth of the coin path.

80. An apparatus according to claim 78, wherein the coil assembly comprises a coil wound in the form of an elongate oval or rectangle.

81. An apparatus according to claim 80, wherein the coil is wound on an elongate I-section former.

82. An apparatus according to claim 78, wherein the coil assembly includes a coil and shielding means to magnetically shield portions of the coil not immediately adjacent the coin path.

83. An apparatus according to claim 80, wherein the axis of the coil is parallel to the length direction of the coin path.

84. A coin validation apparatus comprising means defining first and second reference positions spaced along a vertical coin path, sensor means for detecting a trailing point on a coin passing the first reference position and a leading point on the coin passing the second reference position, means to determine a velocity dependent value for a coin under test, comprising means to define a third reference position downstream of the first reference position and further sensor means for detecting said leading point reaching the third reference position, and processing means for checking the diameter of a coin under test on the basis of said trailing point passing the first reference position and said leading point reaching the second reference position and said third reference position, wherein the processing means is responsive to said further sensor means to derive said velocity dependent value on the basis of the time differences between said leading point reaching the second reference position and said leading point reaching said third reference position and checks the diameter of the coin under test without reference to said leading point reaching the first reference position.

85. An apparatus according to claim 84, wherein the processing means produces the characterising signal on the basis of the results of:

$$\frac{(t_1 - t_2)}{(t_3 - t_2)}$$

where:

$t_1$ is the time of trailing point passing the upper first reference position, and $t_2$ and $t_3$ are the times of the leading point reaching the second and third reference positions.

86. An apparatus according to claim 84, wherein said trailing and leading points are located substantially on the circumference of a coin.

87. An apparatus according to claim 84, wherein the sensor means comprises a beam of optical radiation crossing the coin path and a detector therefore for each said reference position.

88. An apparatus according to claim 87, including reflective means associated with the major walls of the coin path for ensuring the beam is present throughout the depth of the path where said beam crosses the coin path.

89. An apparatus according to claim 88, wherein the reflective means is a strip parallel to said beam.

90. An apparatus according to claim 88, wherein the reflective means comprises a layer of reflective paint.

91. An apparatus according to claim 88, wherein the reflective means comprises a metallic film.

92. An apparatus according to claim 84, including an inductive coin sensing station between said first and second reference positions, the sensing station including a coil assembly beside the coin path and arranged to inductively couple with a major face of a coin therein and such that the magnetic field produced thereby is substantially constant across the width of the coin path.

93. An apparatus according to claim 92, wherein the inductive coin sensing station comprises first and second coils opposite each other across the breadth of the coin path.

94. An apparatus according to claim 92, wherein the coil assembly comprises a coil wound in the form of an elongate oval or rectangle.

95. An apparatus according to claim 94, wherein the coil is wound on an elongate I-section former.

96. An apparatus according to claim 92, wherein the coil assembly includes a coil and shielding means to magnetically shield portions of the coil not immediately adjacent the coin path.

97. An apparatus according to claim 94, wherein the axis of the coil is parallel to the length direction of the coin path.

98. A method of validating a coin comprising the steps of:

(a) moving a coin edgewise past first, second and third reference lines, the reference lines being fixed relative to each other and extending parallel to a major face of the coin;

(b) determining the time difference between a trailing point on the coin passing the first reference line and a leading point on the coin reaching the second reference line;

(c) determining the time difference between said leading point on the coin reaching the first reference line and said leading point on the coin reaching the third reference line; and (d) determining a coin velocity value for the coin under test from the time difference obtained in step (c) and checking the diameter of the coin on the basis of the time differences determined at step (b) and said coin velocity value, without reference to said leading point reaching the first reference line.

99. A method according to claim 98, wherein optical sensing means is used to detect a trailing point on the coin's circumference passing the first reference line and a leading popint on the coin's circumference reaching the second reference line.

100. A method according to claim 98, wherein inductive sensing means are used for determining said time differences.

* * * * *

UNITED STATES PATENT AND TRADEMARK OFFICE

CERTIFICATE OF CORRECTION

PATENT NO. : 6,053,300
DATED : April 25, 2000
INVENTOR(S) : Dennis Wood et al.

It is certified that error appears in the above-identified patent and that said Letters Patent is hereby corrected as shown below:

Column 1,
Line 36, "located at the" should read -- located at least the --.

Column 2,
Line 22, "is full in" should read -- is fully in --.

Column 3,
Line 56, "a trading point" should read -- a trailing point --.

Column 5,
Line 24, "is ranged to" should read -- is arranged to --.
Line 42, "removed,;" should read -- removed; --.
Line 43, "A-A" should read -- AA --.
Line 57, "the passe of " should read -- the passage of --.
Line 64, "A-A" should read -- AA --.

Column 7,
Line 22, "as result" should read -- as a result --.
Line 44, "reduce & indicating" should read -- reduced, indicating --.
Line 64, "data derived" should read -- data, derived --.

Column 8,
Line 66, "u=S/t" should read -- $u = \frac{s}{t}$ --

Column 9,
Line 7, "a dance $s_0$" should read -- a distance $s_0$ --.
Line 55, "signal $x_3$." should read -- signal $x_5$ --.

Column 10,
Line 3, "when of signal" should read -- when signal --.
Line 14, "signal $x_3$." should read -- signal $x_5$ --.
Line 16, "Fig. 11e" should read -- Fig. 11d --.
Line 18, "$x_2$, $x_3$" should read -- $x_2$, $x_5$ --.
Line 20, "corrosion is" should read -- correction is --.

UNITED STATES PATENT AND TRADEMARK OFFICE

CERTIFICATE OF CORRECTION

PATENT NO. : 6,053,300
DATED : April 25, 2000
INVENTOR(S) : Dennis Wood et al.

It is certified that error appears in the above-identified patent and that said Letters Patent is hereby corrected as shown below:

Column 11,
Line 27, "$x_1$, $x_2$, x," should read -- $x_1$, $x_2$, $x_5$ --.
Line 47, " by the wills of" should read -- by the walls of --.
Line 55, "passageway making" should read -- passageway, making --.
Line 61, "the relent" should read -- the relevant --.

Column 12,
Line 62, "is simmer" should read -- is similar --.

Column 13,
Line 64, "portion 2," should read -- portion 2a --.

In the Claims
Claim 78,
Line 55, delete "68" and insert therefore -- 66 --.

Claim 99,
Line 49, delete "popint" and insert therefore -- point --.

Signed and Sealed this

Eleventh Day of September, 2001

*Attest:*

Nicholas P. Godici

*Attesting Officer*

NICHOLAS P. GODICI
*Acting Director of the United States Patent and Trademark Office*